US009846396B2

(12) United States Patent
Nagata

(10) Patent No.: US 9,846,396 B2
(45) Date of Patent: Dec. 19, 2017

(54) TRANSFER DEVICE AND IMAGE FORMING APPARATUS INCORPORATING SAME

(71) Applicant: Atsushi Nagata, Kanagawa (JP)

(72) Inventor: Atsushi Nagata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/287,003

(22) Filed: Oct. 6, 2016

(65) Prior Publication Data

US 2017/0108804 A1 Apr. 20, 2017

(30) Foreign Application Priority Data

Oct. 14, 2015 (JP) ..... 2015-203037
Nov. 27, 2015 (JP) ..... 2015-231811

(51) Int. Cl.
*G03G 15/16* (2006.01)
*G03G 15/01* (2006.01)

(52) U.S. Cl.
CPC ..... *G03G 15/1665* (2013.01); *G03G 15/0131* (2013.01)

(58) Field of Classification Search
CPC ..... G03G 15/0131; G03G 15/1665; G03G 15/1675; G03G 21/20; G03G 2215/0122
USPC ..... 399/66
See application file for complete search history.

(56) References Cited

U.S. PATENT DOCUMENTS

2004/0184830 A1* 9/2004 Miyamoto ..... G03G 15/5062 399/66
2009/0003898 A1 1/2009 Kayahara et al.
2009/0016786 A1 1/2009 Suzuki et al.
2009/0116880 A1 5/2009 Takagaki et al.
2009/0180791 A1 7/2009 Matsushita et al.
2010/0014897 A1 1/2010 Seto et al.
2010/0014903 A1 1/2010 Seto et al.
2010/0232844 A1 9/2010 Saitoh et al.
2010/0239292 A1 9/2010 Fujita et al.
2011/0311249 A1 12/2011 Kubota et al.
(Continued)

FOREIGN PATENT DOCUMENTS

JP 5-158357 6/1993
JP 6-073028 3/1994
(Continued)

*Primary Examiner* — Sophia S Chen
(74) *Attorney, Agent, or Firm* — Harness, Dickey & Pierce, P.L.C.

(57) ABSTRACT

An image forming apparatus includes a plurality of image forming units, a plurality of image bearers, a transfer device, and a controller. The image forming units form a process color toner image and a special color toner image. The transfer device transfers the process color toner image and the special color toner image from the image bearers onto the intermediate transfer member. The controller is configured to correct a transfer bias applied to transfer the special color toner image onto the intermediate transfer member. The controller is configured to decrease the bias in a special color mode in which image formation is performed with only a special color and increase the bias in a full color mode in which image formation is performed with the special color and a process color, according to a degree of degradation of a developer used to form the special color toner image.

14 Claims, 8 Drawing Sheets

(56) References Cited

U.S. PATENT DOCUMENTS

| | | | |
|---|---|---|---|
| 2013/0045031 | A1 | 2/2013 | Nagata et al. |
| 2014/0270819 | A1 | 9/2014 | Wada et al. |
| 2014/0328604 | A1 | 11/2014 | Tanaka et al. |
| 2015/0037054 | A1 | 2/2015 | Nagata et al. |
| 2015/0346651 | A1 | 12/2015 | Nagata et al. |
| 2016/0154345 | A1 | 6/2016 | Nagata |

FOREIGN PATENT DOCUMENTS

| | | |
|---|---|---|
| JP | 9-160298 | 6/1997 |
| JP | 2004-061602 | 2/2004 |
| JP | 2009-168925 | 7/2009 |
| JP | 2014-178495 | 9/2014 |

* cited by examiner

TRANSFER DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2015-203037 filed on Oct. 14, 2015 and 2015-231811 filed on Nov. 27, 2015 in the Japan Patent Office, the entire disclosure of each of which is hereby incorporated by reference herein.

BACKGROUND

Technical Field

Aspects of the present disclosure relate to an image forming apparatus incorporating a transfer device.

Related Art

An image forming apparatus is known that transfers toner images from a plurality of image bearers (latent image bearers) onto a transfer target, such as a recording medium or an intermediate transfer member, to form a desired image. For example, a monochrome image forming apparatus is known that transfers a toner image from a single image bearer (photoconductor drum) directly onto a transfer target (e.g., a sheet of paper) to form a desired image. In such an image forming apparatus, for example, the number of printed sheets or the number of printed sheets corresponding to the stirring of developer is measured. Based on the measurement result, the transfer bias is corrected to be a proper transfer current inversely proportional to the time shift of the charge amount of toner. With such correction, even when the charge amount of toner is entirely low due to the degradation of developer over time, the transfer current is corrected to reduce image degradation due to the degradation of developer over time.

SUMMARY

In an aspect of the present disclosure, there is provided an image forming apparatus that includes a plurality of image forming units, a plurality of image bearers, a transfer device, and a controller. The plurality of image forming units forms a process color toner image and a special color toner image. The plurality of image bearers bears the process color toner image and the special color toner image. The transfer device includes an intermediate transfer member, to transfer the process color toner image and the special color toner image from the plurality of image bearers onto the intermediate transfer member. The controller is configured to correct a transfer bias applied to transfer the special color toner image onto the intermediate transfer member. The controller is configured to decrease the transfer bias in a special color mode in which image formation is performed with only a special color and increase the transfer bias in a full color mode in which image formation is performed with all of the special color and a process color, according to a degree of degradation of a developer used to form the special color toner image.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
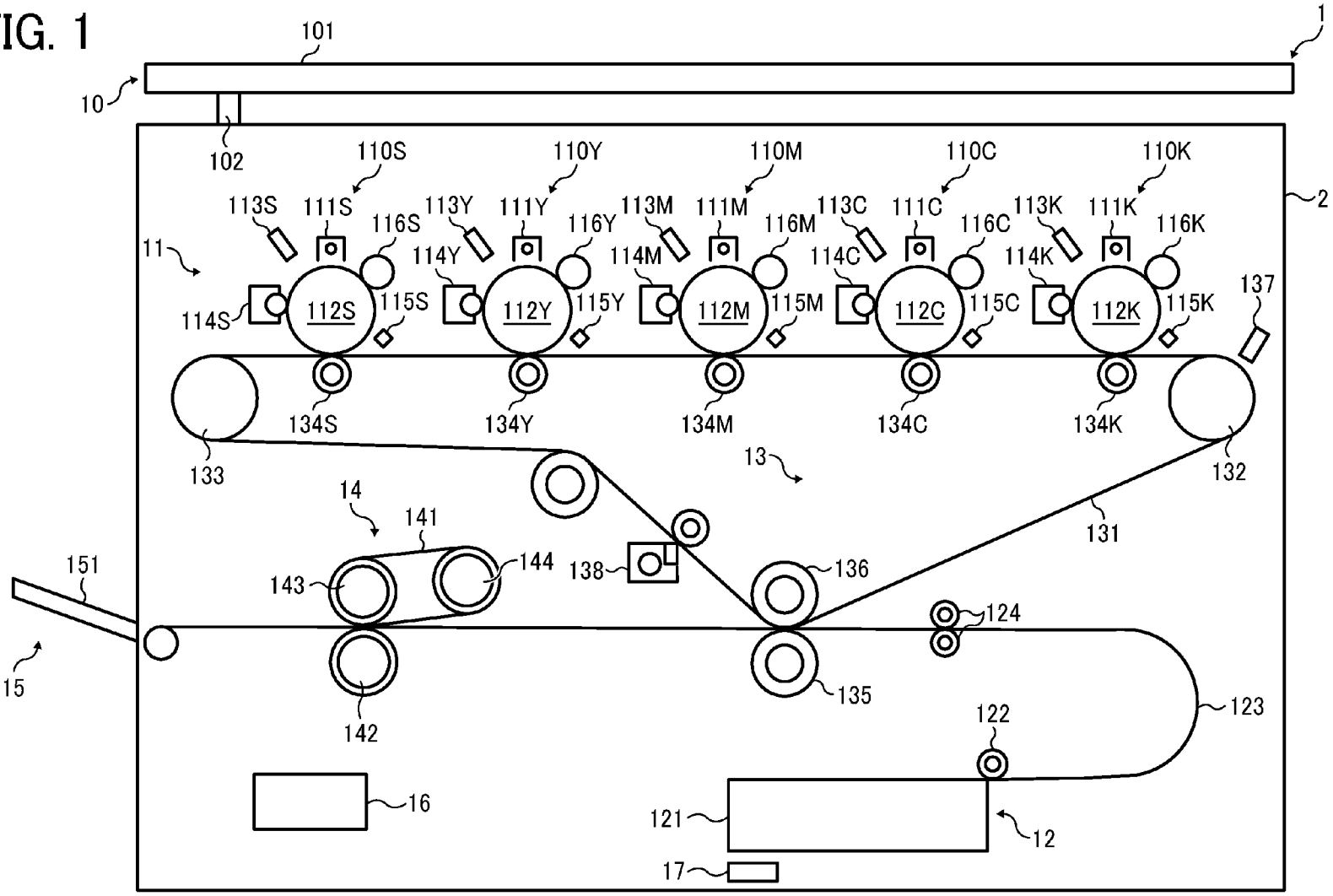
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In an image forming apparatus that forms toner images from a plurality of image bearers onto an intermediate transfer member as a transfer target to form an image, it is preferable to correct the transfer current according to the degree of degradation of developer (a parameter correlating to the degree of degradation of developer). An image forming apparatus may include not only a plurality of image forming units to form toner images of four process colors of yellow, magenta, cyan, and black but also another image forming unit to form a toner image as follow. For example, the other image forming unit forms a toner image of at least one type of colorless or different colors, such as gold and silver, from the process colors, that is, a special color toner image.

However, through the experiments of similarly correcting the transfer current for all colors of toner images according to the degree of degradation of developer in an image forming apparatus including an image forming unit to form a special color toner image, the inventor of the present disclosure has found that the effect of reducing image degradation by the correction varies between the different colors of toner images. In particular, when the image forming unit using special color toner having degraded over time is used to form an image, the transfer rate of the special color toner image more significantly varies than when the image forming units to form toner images of the process colors are used, thus lowering the effect of reducing image degradation.

According to embodiments of the present disclosure, there are provided a transfer device that can excellently transfer a special color toner image even using developer having degraded over time, and an image forming apparatus including the transfer device.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, wherein like reference numerals designate identical or corresponding parts throughout the several views, embodiments of the present disclosure are described below.

An electrophotographic image forming apparatus including a transfer device according to an embodiment of the present disclosure (hereinafter, image forming apparatus 1) is described below. FIG. 1 is a schematic view of the image forming apparatus 1 according to the present embodiment.

The image forming apparatus 1 has a configuration of a tandem system in which a plurality of photoconductors 112Y, 112M, 112C, 112K, and 112S (collectively referred to as photoconductors 112 unless distinguished) is disposed side by side. The photoconductors 112 act as image bearers (latent image bearers) to form images of colors corresponding to color separation of image information sent from an image reader 10 or an external device. In FIG. 1, the image forming apparatus 1 is illustrated as a full-color copier that superimposingly transfers toner images from the photoconductors 112 onto an intermediate transfer belt 131 and collectively transfers the superimposed toner images onto a sheet material, such as a recording sheet of paper, as a recording material to form a multi-color image. The image forming apparatus is not limited to a full-color copier and may be, for example, a full-color printer, facsimile machine, or printing press.

The image forming apparatus 1 illustrated in FIG. 1 is a full-color copier that forms a color image with a tandem-type image forming device (hereinafter, image forming unit 11). The image forming apparatus 1 includes, e.g., the image reader 10, the image forming unit 11, a sheet feed unit 12, a transfer unit 13, a fixing unit 14, a sheet ejection unit 15, and a control unit 16. The image reader 10 reads an image of an original document to create image information. The image reader 10 includes an exposure glass 101 and a reading sensor 102. The image reader 10 irradiates the original document with light, receives light reflected on the document with a sensor, such as charge-coupled device (CCD) or contact image sensor (CIS), and reads electrical color-separation signals for each of three primary colors of light, i.e., red, green, and blue.

The image forming unit 11 includes five image forming units 110S, 110Y, 110M, 110C, and 110K that form and output images of a special color (S), yellow (Y), magenta (M), cyan (C), and black (K), respectively. The special color is, for example, gold or silver. The image forming units 110S, 110Y, 110M, 110C, and 110K have substantially the same configuration except that different color toners of S, Y, M, C, and K are employed as image forming materials. The image forming units 110S, 110Y, 110M, 110C, and 110K are replaced upon reaching the product life cycles. Each of the image forming units 110S, 110Y, 110M, 110C, and 110K is detachably mountable relative to an image forming apparatus body 2 and constitutes a process cartridge. Below, some configurations common among the image forming units 110S, 110Y, 110M, 110C, and 110K are described taking an example of the image forming unit 110K that forms a toner image of black.

The image forming unit 110K includes, e.g., a charging device 111K, the photoconductor 112K serving as an image bearer or a latent image bearer, a developing device 114K, a static eliminator 115K, and a photoconductor cleaner 116K. (Likewise, the image forming units 110S, 110Y, 110M, and 110C include charging devices 111S, 111Y, 111M, and 111C, the photoconductor 112S, 112Y, 112M, and 112C, developing devices 114S, 114Y, 114M, and 114C, static eliminators 115S, 115Y, 115M, and 115C, and photoconductor cleaners 116S, 116Y, 116M, and 116C, respectively.) The charging device 111K, the photoconductor 112K, the developing device 114K, the static eliminator 115K, and the photoconductor cleaner 116K are held in a common holder and detachably attachable together relative to the image forming apparatus body 2, thus allowing simultaneous replacement. The photoconductor 112K has a base and an organic photoconductive layer on the surface of the base and has a drum shape with an external diameter of approximately 60 mm. The photoconductor 112K is rotated in a counterclockwise direction in FIG. 1 by a driving device.

The charging device 111K includes a charging wire that is a charged electrode of a charger. A charging bias is applied to the charging wire to generate electrical discharge between the charging wire and the outer peripheral surface of the photoconductor 112K, thus uniformly charging the surface of the photoconductor 112K. According to the present embodiment, the photoconductor 112K is uniformly charged with a negative polarity that is the same polarity as the polarity of normally-charged toner. As a charging bias, an alternating current (AC) voltage superimposed on a direct current (DC) voltage is employed. Alternatively, instead of using the charger, in some embodiments, a charging roller disposed in contact with or adjacent to the photoconductor 112K is employed.

The uniformly charged surface of the photoconductor 112K is scanned by laser light emitted from an exposure device 113K, thus forming an electrostatic latent image for black on the surface of the photoconductor 112K. Of the entire region of the uniformly charged surface of the photoconductor 112K, the potential of a portion of the photoconductor 112K irradiated with the laser light attenuates and becomes less than the potential of other areas, that is, a background portion (non-image portion), thus forming the electrostatic latent image on the photoconductor 112K. The electrostatic latent image for black on the photoconductor 112K is developed with black toner by the developing device 114K. Accordingly, a visible image, also known as a toner image of black, is formed on the photoconductor 112K. As described later, the toner image is transferred primarily onto an intermediate transfer belt 131 in a process known as a primary transfer process.

The developing device 114K includes a container to store a two-component developing agent including black toner and carrier particles. A developing sleeve disposed inside the container includes a magnetic roller inside the developing sleeve. The magnetic force of the magnetic roller attracts the developing agent onto the surface of the developing sleeve. A developing bias having the same polarity as the polarity of the toner is applied to the developing sleeve. The developing bias has a potential greater than the potential of the electrostatic latent image on the photoconductor 112K and less than the charged potential of the photoconductor 112K. Accordingly, a developing potential from the developing sleeve toward the electrostatic latent image acts between the developing sleeve and the electrostatic latent image of the photoconductor 112K. A non-developing potential acts between the developing sleeve and the background portion of the photoconductor 112K, causing the toner on the developing sleeve to move to the surface of the developing sleeve. By action of the developing potential and the non-developing potential, the black toner on the developing sleeve selectively adheres to the electrostatic latent image formed on the photoconductor 112K, thus forming a black toner image on the photoconductor 112K.

The static eliminator 115K removes residual charges on the surface of the photoconductor 112K after the toner image is primarily transferred onto the intermediate transfer belt 131 in the primary transfer process. The photoconductor cleaner 116K includes a cleaning blade and a cleaning brush to remove residual toner remaining on the surface of the photoconductor 112K after the static eliminator 115K removes charges from the surface of the photoconductor 112K. In the image forming units 110S, 110Y, 110M, and 110C illustrated in FIG. 1, toner images of special color, yellow, magenta, and cyan are formed on the photoconductors 112S, 112Y, 112M, and 112C, respectively, in the same manner as in the image forming unit 110K.

The exposure devices 113S, 113Y, 113M, 113C, and 113K (collectively referred to as the exposure devices 113 unless distinguished) as latent image writing devices are disposed above the image forming units 110S, 110Y, 110M, 110C, and 110K, respectively. The exposure devices 113S, 113Y, 113M, 113C, and 113K scan the photoconductors 112S, 112Y, 112M, 112C, and 112K, respectively, with laser light emitted from a light source, such as a laser diode, according to image information transmitted from external devices, such as the image reader 10 and a personal computer (PC). Each of the exposure devices 113S, 113Y, 113M, 113C, and 113K includes a polygon mirror, a plurality of optical lenses, and a plurality of mirrors. The light emitted from the light source is deflected in a main scanning direction by the polygon mirror rotated by a polygon motor. Each of the photoconductors 112S, 112Y, 112M, 112C, and 112K are irradiated with the deflected light via the optical lenses and the mirrors. Instead of using laser light, in some embodiments, the exposure devices 113 may employ a plurality of light emitting diodes (LED) to emit LED light to optically write images on the photoconductors 112.

The sheet feed unit 12 supplies a sheet material, such as a recording sheet of paper, as a recording material to the transfer unit 13. The sheet feed unit 12 includes a sheet container 121, a pickup roller 122, a sheet feed belt 123, and a pair of registration rollers 124. The pickup roller 122 rotates to pick up a sheet material stored in the sheet container 121 and feed the sheet material to the sheet feed belt 123. The pickup roller 122 picks up and feeds a top sheet of sheet materials stored in the sheet container 121 one by one onto the sheet feed belt 123. The sheet feed belt 123 conveys the sheet material picked up by the pickup roller 122 to the transfer unit 13. The pair of registration rollers 124 feeds the sheet material to a secondary transfer nip as a transfer nip of the transfer unit 13 in appropriate timing such that the sheet material meets a toner image formed on the intermediate transfer belt 131.

The transfer unit 13 is disposed below the image forming units 110S, 110Y, 110M, 110C, and 110K. The transfer unit 13 includes, e.g., a driving roller 132, a driven roller 133, the intermediate transfer belt 131, primary transfer rollers 134S, 134Y, 134M, 134C, and 134K, a secondary transfer roller 135, a secondary-transfer opposed roller 136, a toner amount sensor 137, and a belt cleaning device 138. The intermediate transfer belt 131 as an endless intermediate transfer member is looped around and stretched taut by, e.g., the driving roller 132, the driven roller 133, the secondary-transfer opposed roller 136, and the primary transfer rollers 134S, 134Y, 134M, 134C, and 134K, which are disposed inside the loop formed by the intermediate transfer belt 131. In other words, the intermediate transfer belt 131 is extended in a tensioned state around the driving roller 132, the driven roller 133, the secondary-transfer opposed roller 136, and the primary transfer rollers 134S, 134Y, 134M, 134C, and 134K, which are positioned inside the loop of the intermediate transfer belt 131. The driving roller 132 is driven to rotate clockwise in FIG. 1 by a drive motor. The rotation of the driving roller 132 causes the intermediate transfer belt 131 to endlessly move clockwise in FIG. 1 while contacting the photoconductors 112S, 112Y, 112M, 112C, and 112K. The intermediate transfer belt 131 has a thickness in a range from approximately 20 μm to approximately 200 μm, preferably, a thickness of approximately 60 μm. The volume resistivity of the intermediate transfer belt 131 is in a range from $1\times10^{6}$ Ωcm to $1\times10^{12}$ Ωcm, preferably, approximately $1\times10^{9}$ Ωcm, when the volume resistivity is measured with an applied voltage of 100V by a high resistivity meter, Hiresta UPM-CPHT 45 manufactured by Mitsubishi Chemical Corporation. Preferably, the material of the intermediate transfer belt 131 is, even if not limited to, polyimide resin in which carbon is dispersed.

According to the present embodiment, the toner amount sensor 137 is disposed above and adjacent to the intermediate transfer belt 131 looped around the driving roller 132 with a certain gap between the toner amount sensor 137 and the intermediate transfer belt 131. As a toner amount detector, the toner amount sensor 137 detects an amount of toner in a toner image transferred onto the intermediate transfer belt 131. The toner amount sensor 137 includes a reflective-type photosensor. The toner amount sensor 137 detects the amount of light reflected from a specific toner image (a special color toner, such as a clear toner which is colorless and transparent) adhered to or formed on the intermediate transfer belt 131, to measure the toner adhesion amount of the specific toner image. In some embodiments, a toner density sensor as a toner density detector to detect and measure the density of toner may also act as the toner amount sensor 137. In such a case, an additional toner amount sensor is not required, thus reducing the number of components and the cost.

The primary transfer rollers 134S, 134Y, 134M, 134C, and 134K are disposed opposite the photoconductors 112S, 112Y, 112M, 112C, and 112K, respectively, via the intermediate transfer belt 131 and are rotated to move the intermediate transfer belt 131. Accordingly, primary transfer nips are formed at which an outer surface (outer peripheral surface) of the intermediate transfer belt 131 contacts the photoconductors 112S, 112Y, 112M, 112C, and 112K in a state in which the outer surface of the intermediate transfer belt 131 is pressed against the photoconductors 112S, 112Y, 112M, 112C, and 112K. A primary transfer bias is applied to the primary transfer rollers 134S, 134Y, 134M, 134C, and 134K by a primary-transfer bias power source. Accordingly, primary transfer electric fields are formed between S, Y, M, C, and K toner images on the photoconductors 112S, 112Y, 112M, 112C, and 112K and the primary transfer rollers 134S, 134Y, 134M, 134C, and 134K, respectively, and the S, Y, M, C, and K toner images are primarily transferred onto the intermediate transfer belt 131. In other words, the primary transfer rollers 134S, 134Y, 134M, 134C, and 134K and the intermediate transfer belt 131 constitutes a primary transfer unit to primarily transfer the S, Y, M, C, and K toner images from the photoconductors 112S, 112Y, 112M, 112C, and 112K onto the intermediate transfer belt 131.

The S toner image formed on the surface of the photoconductor 112S for the special color enters the primary transfer nip for the special color with rotation of the photoconductor 112S and is primarily transferred from the photoconductor 112S onto the intermediate transfer belt 131. The S toner image primarily transferred on the intermediate transfer belt 131 passes the primary transfer nips for Y, M, C, and K in turn. The Y, M, C, and K toner images on the photoconductors 112Y, 112M, 112C, and 112K are primarily transferred and superimposed one on another on the S toner image. By the superimposing primary transfer, a composite toner image including the special color toner image and the color toner images other than the special color toner image is formed on the intermediate transfer belt 131.

Each of the primary transfer rollers 134S, 134Y, 134M, 134C, and 134K is an elastic roller that includes a metal cored bar and a conductive sponge layer fixated on the surface of the metal cored bar. In the present embodiment, for example, the outer diameter of the elastic roller is 16 mm and the diameter of the metal cored bar is 10 mm. For example, the resistance R of the sponge layer is calculated from the current I flowing when a voltage of 1000V is applied to the cored bar of each of the primary transfer rollers 134S, 134Y, 134M, 134C, and 134K in a state in which a grounded metal roller having an outer diameter of 30 mm is pressed against the sponge layer with a force of 10 N. The resistance R of the sponge layer calculated from the current I flowing when a voltage of 1000V is applied to the cored bar is approximately $3\times10^{7}\Omega$, based on Ohm's law: R=V/I, where V is a voltage, I is a current, and R is a resistance. The primary transfer bias output by constant current control from the primary transfer bias power source is applied to the primary transfer rollers 134S, 134Y, 134M, 134C, and 134K. In the present embodiment, the primary transfer rollers 134S, 134Y, 134M, 134C, and 134K are used as primary transfer members. In some embodiments, transfer chargers and transfer brushes may be used as the primary transfer members.

The secondary transfer roller 135 rotates with the intermediate transfer belt 131 and a sheet material, such as a recording sheet of paper, as a recording material interposed between the secondary transfer roller 135 and the secondary-transfer opposed roller 136. Accordingly, the secondary transfer nip is formed at which the outer surface of the intermediate transfer belt 131 contacts the secondary transfer roller 135. The secondary transfer roller 135 acts as a nip forming member and a transfer member. The secondary-transfer opposed roller 136 acts as a nip forming member and an opposed member. The secondary transfer roller 135 is grounded. A secondary transfer bias is applied to the secondary-transfer opposed roller 136 by a secondary transfer bias power source. An output terminal of the secondary transfer bias power source is connected to a metal cored bar of the secondary-transfer opposed roller 136. The potential of the metal cored bar of the secondary-transfer opposed roller 136 has a similar or the same value as a value of the voltage output from the secondary transfer bias power source.

By applying the secondary transfer bias to the secondary-transfer opposed roller 136, a secondary transfer electric field is formed between the secondary-transfer opposed roller 136 and the secondary transfer roller 135 so that the toner having a negative polarity is electrostatically transferred from the secondary-transfer opposed roller 136 to the secondary transfer roller 135. Such a configuration allows the toner having the negative polarity on the intermediate transfer belt 131 to move from the secondary-transfer opposed roller 136 to the secondary transfer roller 135. In other words, the secondary-transfer opposed roller 136 and the intermediate transfer belt 131 constitutes a secondary transfer unit to secondarily transfer the composite toner image from the intermediate transfer belt 131 onto the sheet material, such as a recording sheet of paper.

The secondary transfer power source uses a direct current (DC) component having the negative polarity that is the same as the polarity of the toner, and has the negative polarity that is the same as the negative polarity of the toner. In some embodiments, instead of applying the secondary transfer bias to the secondary-transfer opposed roller 136 with the secondary transfer roller 135 grounded, the secondary transfer bias may be applied to the secondary transfer roller 135 with the metal cored bar of the secondary-transfer opposed roller 136 grounded. In such a case, the polarity of the DC voltage and the DC component may be different.

In the present embodiment, the secondary-transfer opposed roller 136 has a structure in which a resistance layer is layered on the metal cored bar made of stainless steel or aluminum, and the following characteristics. In other words, the outer diameter of the secondary-transfer opposed roller 136 is approximately 24 mm, and the diameter of the metal cored bar is approximately 16 mm. Examples of materials of the resistance layer include, but are not limited to, polycarbonate, fluorine-based rubber, silicon rubber, and the like in which conductive particles, such as carbon and metal complex, are dispersed, or rubbers, such as nitrile rubber (NBR) and Ethylene Propylene Diene Monomer (EPDM), copolymer rubber of nitrile rubber and epichlorhydrin rubber (NBR/ECO), and semiconductive rubber, such as polyurethane. The volume resistivity of the resistance layer is in a range from $10^{6}\Omega$ to $10^{12}\Omega$, more preferably, in a range from $10^{7}\Omega$ to $10^{9}\Omega$. The resistance layer may be a foam-type layer having a hardness in a range from 20 degrees to 50 degrees on Asker C hardness scale or a rubber-type layer having a hardness in a range from 30 degrees to 60 degrees on Asker C hardness scale. Since the secondary-transfer opposed roller 136 contacts the secondary transfer roller 135 via the intermediate transfer belt 131, the resistance layer is preferably a sponge-type layer that allows the secondary-transfer opposed roller 136 to reliably contact the secondary transfer roller 135 via the intermediate transfer belt 131 even with a low contact pressure. As the contact pressure of the intermediate transfer belt 131 with the secondary-transfer opposed roller 136 is greater, characters and thin lines are more likely to drop out. Hence, the sponge-type layer can more reliably prevent such drop-out.

After the intermediate transfer belt 131 passes through the secondary transfer nip, the residual toner not having been transferred onto a sheet material, such as a recording sheet of paper, remains on the intermediate transfer belt 131. The residual toner is removed from the surface of the intermediate transfer belt 131 by a cleaning blade of the belt cleaning device 138 that contacts the surface of the intermediate transfer belt 131. The fixing unit 14 employs a belt fixing system and includes a fixing belt 141 formed into an endless loop, a fixing roller 143, a heating roller 144, and a pressing roller 142 that is pressed against the fixing belt 141. The fixing belt 141 is looped around the fixing roller 143 and the heating roller 144. At least one of the fixing roller 143 and the heating roller 144 includes a heat source, such as a heater, a lamp, or an electromagnetic-induction heating device. The fixing belt 141 is interposed between the fixing roller 143 and the pressing roller 142 and pressingly contacts the fixing roller 143, thereby forming a heated area called a fixing nip between the fixing belt 141 and the pressing roller 142.

When the sheet material, such as a recording sheet of paper as a recording material, is fed to the fixing nip, the sheet material is nipped in the fixing nip with the surface of the sheet material bearing the unfixed toner image tightly contacts the fixing belt 141. Since toner in the toner image is softened under heat and pressure, the toner image is fixed on the sheet material and ejected to the outside of the image forming apparatus body 2. In a configuration in which an image is also formed on the other surface opposite the surface of the sheet material on which the toner image is transferred, a sheet-material reversing device is disposed to reverse the sheet material. After the toner image is fixed on the sheet material, the sheet material is conveyed to the sheet-material reversing device and reversed with the sheet-material reversing device. Subsequently, as in the above-described image forming process, a toner image is formed on the opposite surface of the sheet material. When the sheet material having the toner image fixed by the fixing unit 14 is ejected to the outside of the image forming apparatus body 2 via ejection rollers of the sheet ejection unit 15 and stacked on a sheet ejection container 151, such as a sheet ejection tray.

Next, the image forming apparatus 1 according to the present embodiment is described taking a plurality of examples. However, in the examples described below, the transfer bias is controlled based on the electric current value. However, the control of the transfer bias is not limited to the control based on the electric current value. In some embodiments, the transfer bias may be controlled based on the voltage value.

Example 1

Next, a first example (Example 1) of the image forming apparatus 1 according to the present embodiment is described below. For an image forming apparatus, such as the image forming apparatus 1 according to the present embodiment, a toner image on the image bearer is transferred onto the intermediate transfer member as a transfer target by applying transfer bias from a transfer unit of the transfer device. However, the percentage (transfer rate) of the toner transferred to the intermediate transfer member, such as the intermediate transfer belt 131, in the toner constituting the toner image on image bearer, such as the photoconductor 112, varies with the charge amount of toner and the amount of the transfer bias. Generally, as the current value of the transfer current is greater, the transfer efficiency is more increased, thus causing more toner to be transferred onto the intermediate transfer member. However, if the transfer current is too great, the transfer rate would adversely drop or image degradation, such as uneven density, may occur in the transferred toner image. Such phenomenon may occur in any of primarily transfer and secondary transfer. For such an image forming apparatus, developer may degrade by the repeat of image forming operation.

Generally, as the developer degrades over time, the charge amount of toner (for example, the specific charge of Q/M being the charge amount of developer per unit mass) gradually decreases and becomes an entirely low state. Accordingly, even if a proper transfer bias is set based on the charge amount of toner at an initial period of use at which developer is not degraded yet, the proper transfer bias turns to be an improper value due to a reduction in the charge amount of toner after an elapse of time in which developer degrades. Consequently, if the transfer bias set in the initial period is still used after the elapse of time in which the developer has degraded, the transfer rate decreases over time, thus causing image degradation.

As described above, the preferable values of the transfer current (primary transfer current) to transfer a toner image from the photoconductor to the intermediate transfer member vary as the charge amount of toner decreases. Therefore, the primary transfer current is preferably corrected in response to the degree of degradation of developer to reduce degradation in image quality in response to the degree of degradation of developer. In addition, through diligent studies, the inventor has found that the transfer rate varies with image pattern (e.g., the image area ratio in a main scanning direction), and in particular, in a reduced state of Q/M, the transfer rate is greatly affected by image pattern.

The transfer rate varies with, for example, the size, thickness, and material of the intermediate transfer belt 131 and the sheet material, temperature and humidity, the charge amount (Q/M) of developer on the photoconductor 112, stain of each transfer member of the transfer unit 13, moisture state of each transfer member, the contact state of each photoconductor 112 and the intermediate transfer belt 131, the contact state of the intermediate transfer belt 131 and the sheet material, the rotation speed of the photoconductor 112, and the conveyance speed of the sheet material. The transfer rate is preferably adjusted in consideration of the above-described conditions. However, as described above, in particular, the change in the charge amount of developer affects the transfer rate. As the charge amount of developer changes, for example, the optimal value of the primary transfer bias applied to each primary transfer roller 134 to transfer a toner image from the photoconductor 112 to the intermediate transfer belt 131 changes. Hence, for example, the value (current value or voltage value) of the transfer bias supplied to the transfer member may be adjusted in response to the number of sheet materials to be printed.

Such a configuration allows the transfer bias to be set in response to a change in the charge amount of developer degrading over time. However, the transfer bias is not set in consideration of the influence of image pattern to be formed. As the influence of image pattern to be formed, for example, image quality may become unstable depending on the image area ratio, in other words, whether the image is an entirely solid image, a line-shaped vertical band image, or a patched image. The inventor has considered that the image quality may be unstable depending on the image area ratio because the amount of toner and other materials constituting the image is different depending on whether the image is an entirely solid image or a line-shape image. Through diligent examinations, the inventor has found that the instability of the image quality due to a change in the image area ratio is greatly affected by a change in the charge amount of developer (Q/M).

For example, the charge amount of developer (Q/M) decreases as the developer degrades over time depending on the environment of use and the number of sheet materials used. As the charge amount of developer (Q/M) decreases, the transfer rate by the image area ratio changes. For example, even if an excellent transfer performance (transfer rate) is obtained in an area of a low image area ratio with a transfer bias, a transfer shortage may occur in an area of a high image area ratio with the transfer bias. In other words, since the transfer rate shifts with the image area ratio, the preferable transfer current value shifts with image pattern. For full-color image forming apparatuses, such as copiers or printers, various ways of use, such as, making of invitation card for home party, handouts and advertisements of small stores by full-color printers are proposed.

Hence, clear toner for highly glossy image, fluorescent toner for fluorescent images, and special color toners (spot color toner) of red and green used to extend the color reproduction area are increasingly employed in addition to process color toners of yellow, magenta, cyan, and black. In fields requiring decorativeness (for example, the frame of testimonial, gift wrapping paper, and gift presenting envelope), electrophotographic copies or prints of, e.g., gold and silver are demanded. Accordingly, there are demands for special color toners, such as gold and silver. For typical color printers, yellow, magenta, and cyan are superimposed to express metallic luster. However, the obtained image is a gold image of a low reflectivity, which may not meet the customer's demand.

As special color toners, such as gold and silver, for example, gold toner may be used that contains, as colorant, pigments in which titanium dioxide and iron oxide are coated in a shape of thin film on squamous mica. In another example, fine powders of alloy containing copper, zinc, and aluminum as main ingredients are used as a colorant to reproduce gold color. However, generally, such pigments are conductive and thus have a low electric resistance value, and are unlikely to retain charge in toner of a low volume resistivity. Such phenomenon is supposed to occur because a reduction in resistance causes a reduction in apparent electrostatic capacity. Accordingly, as the charge performance of carriers decreases over time, the charge amount of toner is more likely to decrease than process color toner of a relatively high volume resistivity. As the charge amount of toner decreases over time, the optimal value of the transfer current in, particularly, an image of a high image area ratio (e.g., an entirely solid image) shifts between at the initial period of use and after the elapse of time. Under a constant transfer current, an excess transfer may occur over time and the transfer rate may decrease, causing a thin-color image.

Hence, in Example 1, the transfer device (the transfer unit 13) can excellently transfer special color toner even with a developer having degraded over time. Further, in Example 1, the image forming apparatus 1 can form an excellent image regardless of image pattern, with the toner that has degraded over time and changed in the charge amount of toner (Q/M), in particular, with special color toner, such as gold or silver.

Figure 2:
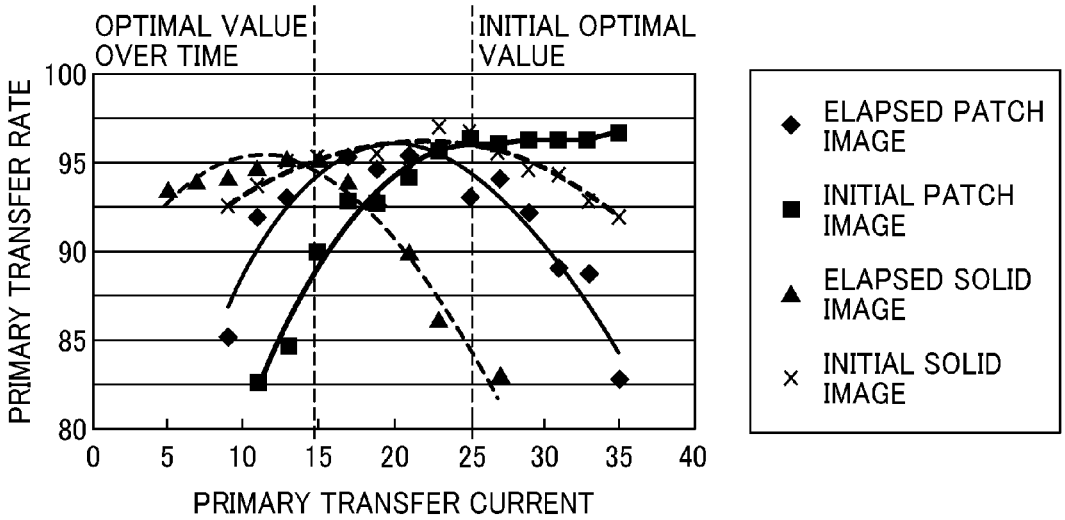
FIG. 2 is a graph of relationships between primarily transfer rate and primary transfer current, on tone images of different image area ratios in a main scanning direction, at an initial period at which developer is not degraded yet and after an elapse of time in which developer degrades.

FIG. 2 is a graph of relationships between the primarily transfer rate and the primary transfer current, on tone images of different image area ratios in the main scanning direction, at the initial period at which developer is not degraded yet and after the elapse of time in which developer degrades. FIG. 2 is a graph of relationships between the primarily transfer rate and the primary transfer current, on the patch image and the solid image in the main scanning direction, at the initial period at which developer is not degraded yet and after the elapse of time in which developer degrades. The patch image is a single-color, entirely-solid image having a vertical size (in the main scanning direction) of 20 mm and a horizontal size (in the sub-scanning direction) of 10 mm with a maximum image density. The solid image is a single-color, entirely-solid image having a vertical size of 20 mm and a horizontal size of 300 mm with a maximum image density. As illustrated in FIG. 2, each graph indicates a relationship in which the primary transfer current has a value (peak) at which a maximum primary transfer rate is obtained. However, the relationship is different between at the initial period and after the elapse of time and between the patch image and the solid image.

At the initial period at which developer is not degraded yet, a value of the primary transfer current to obtain a maximum primary transfer rate (97%) in a range in which the same level of the primarily transfer rate is obtained in both of the patch image and the solid image is set as an initial optimal value (25 μA) illustrated in FIG. 2. After the elapse of time in which developer degrades, the patch image and the solid image has a relationship illustrated in FIG. 2 between the primary transfer rate and the primary transfer current. Here, it is found that the value (peak) of the primary transfer current, at which the solid image has a maximum primary transfer rate after an elapse of time, greatly shifts to a lower side of the primary transfer current (absolute value) than at the initial period.

If, after the elapse of time, image forming operation is performed with the same value (25 μA) of the primary transfer current as at the initial period, as illustrated in FIG. 2, a primary transfer rate of approximately 93% is obtained for the patch image. However, for the entirely solid image, the primary transfer rate drops to approximately 85%. An optimal value of the primary transfer current to obtain a maximum primary transfer rate (93%) in a range in which the same level of the primary transfer rate is obtained in both of the patch image and the solid image is the optimal value over time (15 μA) illustrated in FIG. 2. As described above, the optimal value of the primary transfer current greatly shifts over time to a lower side of the absolute value than at the initial period. Therefore, the primary transfer current is preferably corrected to reduce the primary transfer current in response to the degree of degradation of developer.

Here, the degree of degradation of developer, in other words, the degree of degradation of developer indicating a degree of decrease of the charge amount of toner can be calculated using various parameters. For example, one or a combination of two or more of various parameters correlated with the degree of degradation of developer, such as information on the number of sheet materials to be printed, information on the conveyance distance of developer, information on the consumption of toner in the developing device 114, and the time elapsed from the installation of new developer, can be used. In addition, for example, the inclination (developing y) of the developing amount relative to the developing bias under image quality adjustment control (process control) is correlated with the degree of degradation of developer and therefore can be used as a parameter to calculate the degree of degradation of developer. The inventor has found that the shift of the transfer rate between at the initial period and after the elapse of time is strongly correlated with Q/M.

Figure 3:
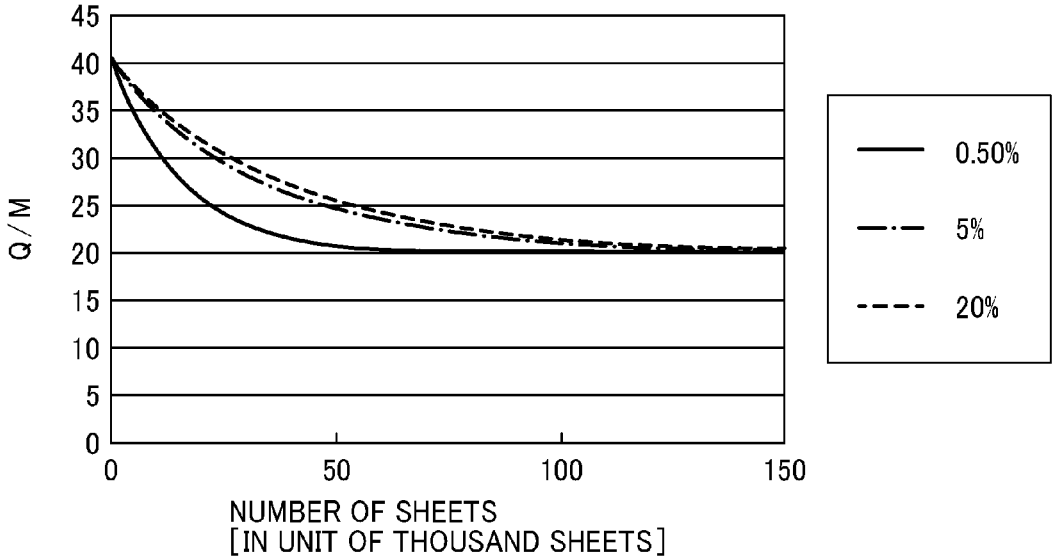
FIG. 3 is a graph of a relationship between the number of sheet materials on which images are to be formed (the number of sheet materials to be printed) and the charge amount of toner (Q/M)

FIG. 3 is a graph of a relationship between the number of sheet materials on which images are to be formed (the number of sheet materials to be printed) and the charge amount of toner (Q/M). The graph indicates a transition of the charge amount of toner (Q/M) obtained when images of the image area ratios (coverages) of 0.5%, 5%, and 20% are consecutively formed. In the graph illustrated in FIG. 3, as image formation is performed with a lower image area ratio (lower coverage), the charge amount of toner (Q/M) more rapidly decreases. As the image area ratio is lower, the consumption of toner in the developing device 114 is less. Accordingly, the amount of toner remaining in the developing device 114 is greater, thus increasing the stress against toner.

Figure 4:
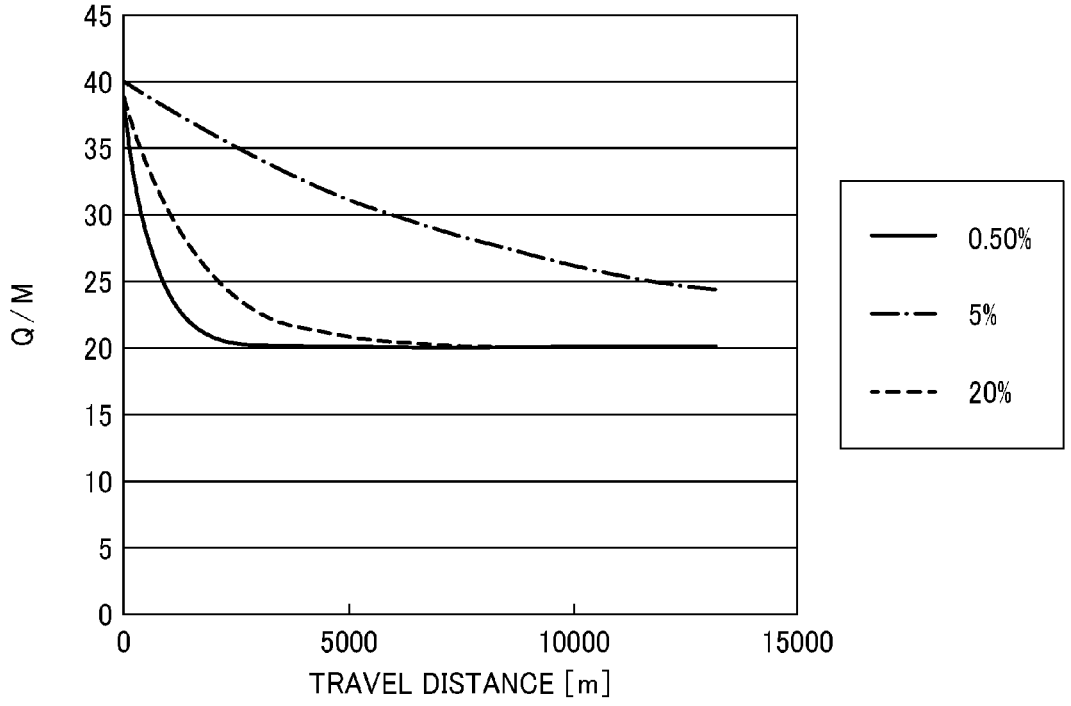
FIG. 4 is a graph of a relationship between the conveyance distance of developer and the charge amount of toner (Q/M)

FIG. 4 is a graph of a relationship between the conveyance distance of developer and the charge amount of toner (Q/M). The graph indicates a transition of the charge amount of toner (Q/M) obtained when images of the image area ratios of 0.5%, 5%, and 20% are consecutively formed. According to the graph illustrated in FIG. 4, the charge amount of toner (Q/M) more rapidly decreases in the case of the high image area ratio (20%) as well as in the case of the low image area ratio (0.5%). Here, for example, an estimate calculated by multiplying the process linear velocity (the linear velocity of the photoconductor) by the operation time of the developing device can be used as the conveyance distance of developer.

Comparing FIG. 3 with FIG. 4, when the transition of the charge amount of toner is simply calculated from only the number of sheet materials on which images are to be formed (the number of sheet materials to be printed) or the conveyance distance of developer and the primary transfer current is corrected in response to the charge amount of toner, a relatively large error might occur in the estimate of the charge amount of toner, depending on the condition of image forming operation (the difference in image area ratio), thus hampering proper correction of the primary transfer current. Accordingly, the condition of image forming operation (the difference in image area ratio), as well as the number of sheet materials on which images are to be formed (the number of sheet materials to be printed) and the conveyance distance of developer, is preferably considered as parameters of the degree of degradation of developer.

Hence, as the degree of degradation of developer in Example 1, for example, a value calculated by the following formula 1 is used:

$$\text{Degree of degradation of developer} = (\text{conveyance distance of developer})^2/(\text{consumption of toner}) \qquad \text{formula 1}$$

Figure 5:
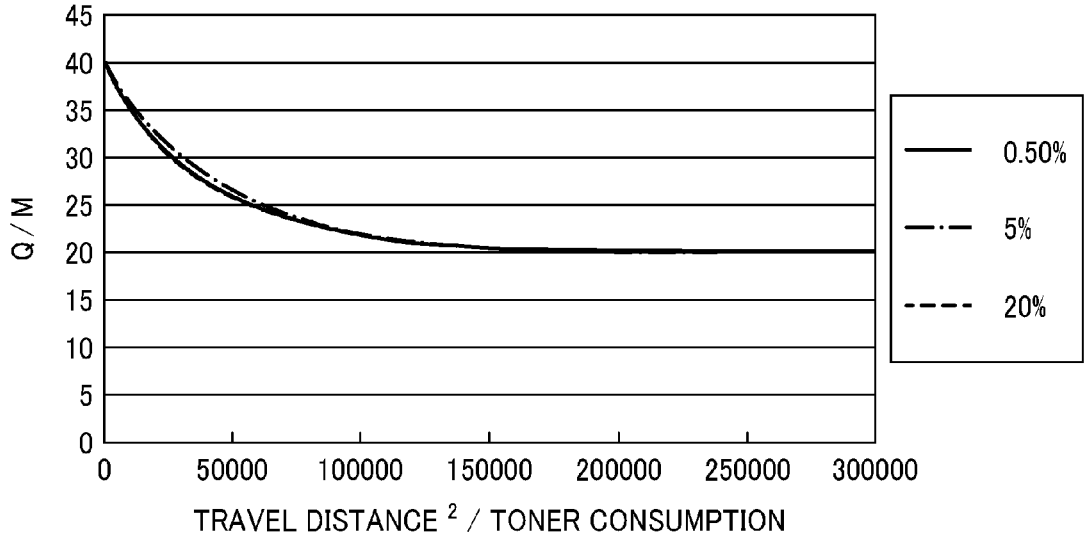
FIG. 5 is a graph of a relationship between the degree of degradation of developer and the charge amount of toner (Q/M) in Example 1.

FIG. 5 is a graph of a relationship between the degree of degradation of developer and the charge amount of toner (Q/M) in Example 1. According to the graph illustrated in FIG. 5, the charge amount of toner (Q/M) decreases at a constant rate regardless of print condition (image area ratio). The graph indicates a transition of the charge amount of toner (Q/M) obtained when images of the image area ratios of 0.5%, 5%, and 20% are consecutively formed. According to the graph illustrated in FIG. 5, the charge amount of toner (Q/M) similarly transits in any image area ratio. Accordingly, by using the degree of degradation of developer calculated from the above-described formula 1, the degree of degradation of developer properly reflecting the transition of the charge amount of toner can be obtained even if the condition of image forming operation is different (the image area ratio is different). Accordingly, by correcting the primary transfer current in response to the degree of degradation of developer, the primary transfer current can be properly corrected regardless the condition of image forming operation.

The setting value of the primary transfer current in Example 1 is calculated from the following formula 2:

$$\text{Setting value} = \text{reference current value} \times \text{environmental correction coefficient} \times \text{time correction coefficient} \qquad \text{formula 2}$$

The reference current value is a reference value of primary transfer current determined according to the type of sheet of paper or the thickness of sheet of paper. The environmental correction amount (environmental correction coefficient) is a correction coefficient in response to changes in environmental conditions, such as temperature and humidity. The time correction amount (time correction coefficient) is a correction amount calculated according to the degree of degradation of developer calculated from the above-described formula 1.

In Example 1, for example, a temperature humidity sensor CHS-CSC-18 manufactured by TDK Corporation is used as a temperature humidity sensor 17 being an environmental information acquisition unit. Temperature information is acquired from a thermistor output in the temperature humidity sensor 17, and humidity information is acquired from a humidity sensor output in the temperature humidity sensor 17. Information on temperature and humidity is detected by sampling each time one minute passes after the image forming apparatus 1 is powered on. The environmental correction to the reference current value is performed in a cycle similar to a cycle of the detection of temperature and humidity. The mount position of the temperature humidity sensor 17 is, though not limited to any particular position, preferably away from a heat source, such as the fixing unit 14. Hence, in Example 1, as illustrated in FIG. 1, the temperature humidity sensor 17 is disposed below the sheet feed unit 12.

Figure 6:
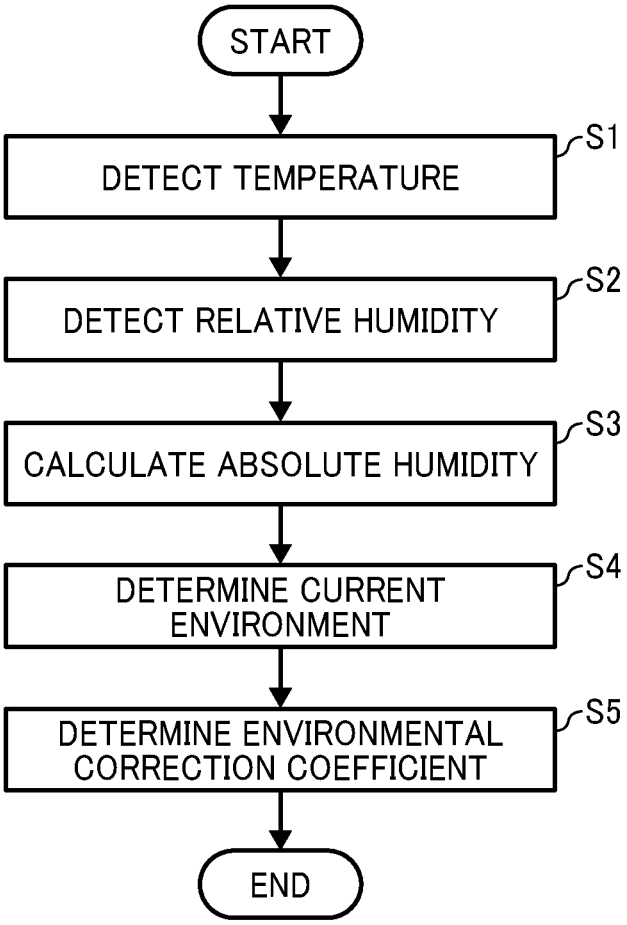
FIG. 6 is a flowchart of an example of a process of determining an environmental correction amount (environmental correction coefficient) in Example 1 of the present disclosure.

FIG. 6 is a flowchart of an example of a process of determining the environmental correction amount (the environmental correction coefficient) in Example 1. First, a thermistor output in the temperature humidity sensor is detected, and a temperature is determined from a conversion table of thermistor output and temperature based on the correlation of thermistor output and temperature (S1). Next, a humidity sensor output in the temperature humidity sensor is detected, and the relative humidity is determined from the temperature determined at S1 and a conversion table of humidity sensor output and relative humidity (S2). The conversion table of humidity sensor output and relative humidity is used to determine relative humidity based on temperature on the horizontal axis and humidity on the vertical axis. Next, an absolute humidity is calculated at S3 from the relative humidity determined at S2 and a conversion table of relative humidity and absolute humidity. The conversion table of relative humidity and absolute humidity is used to determine absolute humidity based on relative humidity on the horizontal axis and temperature on the vertical axis. Note that the absolute humidity can be calculated by an equation from temperature and relative humidity.

Next, the current environment is determined from the calculated absolute humidity and a conversion table of absolute humidity and current environment (S4). The determination step of the current environment determines which of predetermined environmental categories, such as L/L (low temperature and low humidity: 19° C. and 30%), M/L (moderate temperature and low humidity: 23° C. and 30%), M/M (moderate temperature and moderate humidity: 23° C. and 50%), M/H (moderate temperature and high humidity: 23° C. and 80%), and H/H (high temperature and high humidity: 27° C. and 80%), the current environment falls into. Here, L/L represents a low-temperature and low-humidity environment, M/M represents a moderate-temperature and moderate-humidity environment, M/H represents a moderate-temperature and high-humidity environment, and H/H represents a high-temperature and high-humidity environment. However, the combinations of values of temperature and humidity of environmental categories are not limited to the above-described combinations. At S5, the environmental correction coefficient (environmental correction amount) is determined according to the current environment determined at S4. Since the detection of the temperature humidity sensor does not require mechanical operation, monitoring can be constantly performed, thus allowing consecutive control in response to environmental changes.

Figure 7A:
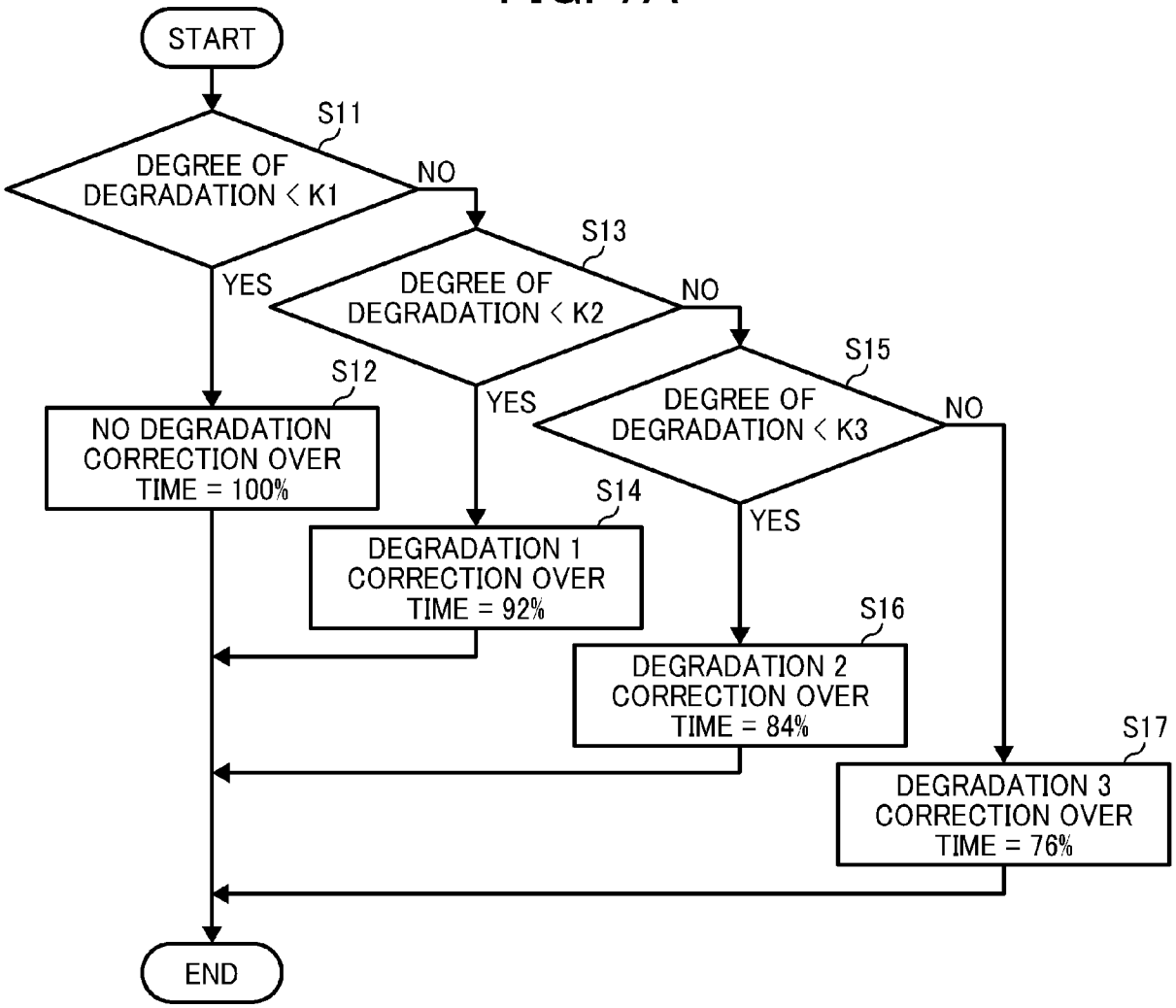
FIG. 7A is a flowchart of an example of a process of determining a time correction amount (time correction coefficient) in Example 1.

FIG. 7A is a flowchart of an example of a process of determining the time correction amount (time correction coefficient) in Example 1. The time correction amount (time correction coefficient) in Example 1 is calculated according to the degree of degradation of developer calculated from the above-described formula 1. The degree of decrease in the charge amount of toner indicated by the degree of degradation of developer is affected by degradation of developer, degradation of the structure for charging developer, and various factors that decrease the charge amount of toner constituting a toner image on the intermediate transfer belt 131. However, the inventor considers as one main factor that toner is stirred in the developing device 114K. In other words, the main factor is the conveyance distance of developer, which can be estimated from the process linear velocity and the operation time of the developing device 114K.

The inventor considers the consumption of toner in the developing device 114K as another main factor affecting the degree of decrease in the charge amount of toner. As the consumption of toner is less, toner stays in the developing device 114K for a longer time, more repeatedly receives sliding and friction from, e.g., the developing sleeve and the photoconductor 112, and degrades more. The consumption of toner is calculated in the control unit 16 based on the image area ratio of the toner image.

In Example 1, using the values of the conveyance distance of developer and the consumption of toner affecting the degree of decrease in the charge amount of toner, the control unit 16 calculates an index value indicating the degree of degradation of developer and (the degree of decrease in the charge amount of toner), from the above-described formula 1. In Example 1, the control unit 16 compares the degree of degradation of developer thus calculated with predetermined threshold values K1, K2, and K3 to determine the time correction coefficient (time correction amount). The consumption of toner used to calculate the degree of degradation of developer is a consumption of toner used until the previous image formation. The consumption of toner is reset on replacement of the process cartridge constituting the image forming unit.

For example, as illustrated in FIG. 7A, at S11 the control unit 16 determines whether the degree of degradation of developer is smaller than the threshold value K1. When the control unit 16 determines that the degree of degradation of developer is smaller than the threshold value K1 (YES at S11), the control unit 16 classifies the degree of degradation into "no degradation" and sets the time correction coefficient to 100% (S12). When the degree of degradation is not smaller than the threshold value K1 (NO at S11), the control unit 16 determines whether the degree of degradation of developer is smaller than the threshold value K2 (S13). When the control unit 16 determines that the degree of degradation of developer is smaller than the threshold value K2 (YES at S13), the control unit 16 classifies the degree of degradation into "degradation 1" and sets the time correction coefficient to 92% (S14). When the degree of degradation is not smaller than the threshold value K2 (NO at S13), the control unit 16 determines whether the degree of degradation of developer is smaller than the threshold value K3 (S15). When the control unit 16 determines that the degree of degradation of developer is smaller than the threshold value K3 (YES at S15), the control unit 16 classifies the degree of degradation into "degradation 2" and sets the time correction coefficient to 84% (S16). When the control unit 16 determines that the degree of degradation of developer is not smaller than the threshold value K3 (NO at S15), the control unit 16 classifies the degree of degradation into "degradation 3" and sets the time correction coefficient to 76% (S17).

In Example 1, as the above-described threshold values, for example, K1=10000, K2=30000, and K3=70000 are used. However, the threshold values are not limited to the above-described values. In the present embodiment, the degree of degradation of developer is categorized into four degradation categories with three threshold values. However, in some embodiments, the degree of degradation of developer may be categorized into a larger or smaller number of degradation categories, or the value of the time correction coefficient may be consecutively changed with the degree of degradation. The time correction is performed, for example, per print job, each time the number of sheet materials on which images are formed reach a threshold value, or per image formation. Here, in Example 1, the control unit 16 controls functions of the developer degradation detector to detect the degree of degradation of developer and the toner density detector to detect to detect the density of toner on the intermediate transfer belt 131 and operation functions of the transfer unit 13, such as control functions of the transfer bias. However, the control configuration of such functions is not limited to the above-described configuration. In some embodiments, for example, a transfer-unit controller (control unit) to control operation functions of the transfer unit 13 may be disposed in the transfer unit 13, separately from the control unit 16 to control the entire image forming apparatus.

Here, a description is given of toner used in Example 1. Previously, the inventor thought that it is preferable to use toner having a volume resistivity greater than 10.7 log Ωcm to obtain desired charge in the developing device 114 and desired charge by charge-up (charge injection) of the transfer unit 13. However, for the configuration including the image forming unit 110S for special color toner as in the image forming apparatus 1 according to Example 1, the volume resistivity of the special color toner, such as gold or silver, may be not greater than 10.7 log Ωcm, which requires some countermeasures. Generally, toner of a low volume resistivity is less likely to retain charge than toner of a high volume resistivity.

In fields requiring decorativeness (for example, the frame of testimonial, gift wrapping paper, and gift presenting envelope), electrophotographic copies or prints of, e.g., gold and silver are demanded. Accordingly, there are demands for special color toners, such as gold and silver. For typical color printers, yellow, magenta, and cyan are superimposed to express metallic luster. However, the obtained image is a gold or silver image of a low reflectivity, which may not meet the customer's demand. Generally, such special color toners have different electric characteristics depending on the pigments used in the special color toners. For example, pigments of, e.g., gold or silver toner, are electrically conductive and have a low volume resistivity.

In particular, for special color toners, such as gold toner and silver toner, the inventor infers that, as the electric resistance is lower, the apparent electrostatic capacity is lower and less likely to retain charge. Accordingly, after an elapse of time in which developer degrades, the charge amount of toner is likely to decrease in toner of a low volume resistivity than in toner of a high volume resistivity. As the charge amount of toner decreases over time, as described above, the optimal value of the primary transfer current in, particularly, an image of a high image area ratio (e.g., an entirely solid image) shifts between at the initial period of use and after the elapse of time. Under a constant transfer current, excess transfer may occur over time and image density may significantly decrease.

Accordingly, a difference in volume resistivity causes a difference in the rate of decrease in the charge amount of toner, thus affecting the degree of decrease in image density. Therefore, excellent transfer can be performed regardless of the image area by comparing the degree of degradation of toner with an optimal threshold value for each of the image forming units 110S, 110Y, 110M, 110C, and 110K (each of toner colors) and correcting the primary transfer current over time. Hence, for the image forming apparatus 1 according to Example 1, when special color toner (the image forming unit 110S) is not used, primary transfer current correction is performed with the above-described time correction coefficient (time correction amount), to (stepwisely) decrease the primary transfer current in the image forming units 110Y, 110M, 110C, and 110K over time. When special color toner is used, primary transfer bias correction is performed to (stepwisely) decrease the primary transfer bias in the image forming unit 110S over time in a single special color mode (S mode) using only the special color toner and to (stepwisely) increase the transfer bias in a full color mode (FCS mode or all color mode) using all of the image forming units 110Y, 110M, 110C, 110K, and 110S.

When special color toner is used, as described above, the primary transfer bias is controlled in different manners between the S mode using only the special color toner and the FCS mode using all of the image forming units 110 for the following reason. For example, since the secondary transfer bias in the FCS mode is set higher than in the S mode, the special color toner having turned into a lower charged state over time may be thin in an image because only the special color toner is excessively transferred in secondary transfer in the FCS mode. By contrast, for the S mode, since the secondary transfer bias is not set to be so higher than in the FCS mode, such a phenomenon does not occur in which the special color toner is excessively transferred in the secondary transfer and thin in the image. Hence, in the S mode, the primary transfer current is controlled to decrease over time, thus allowing excellent transfer to be performed regardless of the image area ratio. In the FCS mode, to prevent an insufficient density of special color toner in the secondary transfer, the primary transfer bias is controlled to increase over time. Thus, the charge amount is increased by charge-up (charge injection) in the primary transfer unit, preventing an insufficient density of the special color toner in the secondary transfer.

As described above, even using developer having degraded over time, controlling the primary transfer current of the image forming unit 110K allows the transfer unit 13 as the transfer device to transfer an excellent special color toner image. Further, by controlling the primary transfer current of the image forming unit 110S as described above, the image forming apparatus 1 can form an excellent image regardless of image pattern, with the toner that has degraded over time and changed in the charge amount of toner (Q/M), in particular, with special color toner, such as gold or silver.

Furthermore, a similar configuration to the transfer configuration of special color toner, such as gold or silver can be used in transfer of process color toner images of yellow, magenta, cyan, and black. Such a configuration allows the process color toner images to be more excellently transferred regardless of the image area ratio, even with toner that has degraded over time and changed in the charge amount of toner (Q/M).

Here, a description is given of an example in which the primary transfer bias is increased over time to prevent an insufficient density of special color toner in the secondary transfer in the FCS mode. In the FCS mode, timing and a method of increasing the primary transfer current over time are the same as in the S mode. For example, as illustrated in table 1 below, the time correction coefficient is stepwisely increased per degradation category in the S mode.

TABLE 1

| | Categories of Degradation | | |
|---|---|---|---|
| Mode | Degradation 1 | Degradation 2 | Degradation 3 |
| S mode | 92% | 84% | 76% |
| Full-color mode | 105% | 110% | 120% |

Figure 7B:
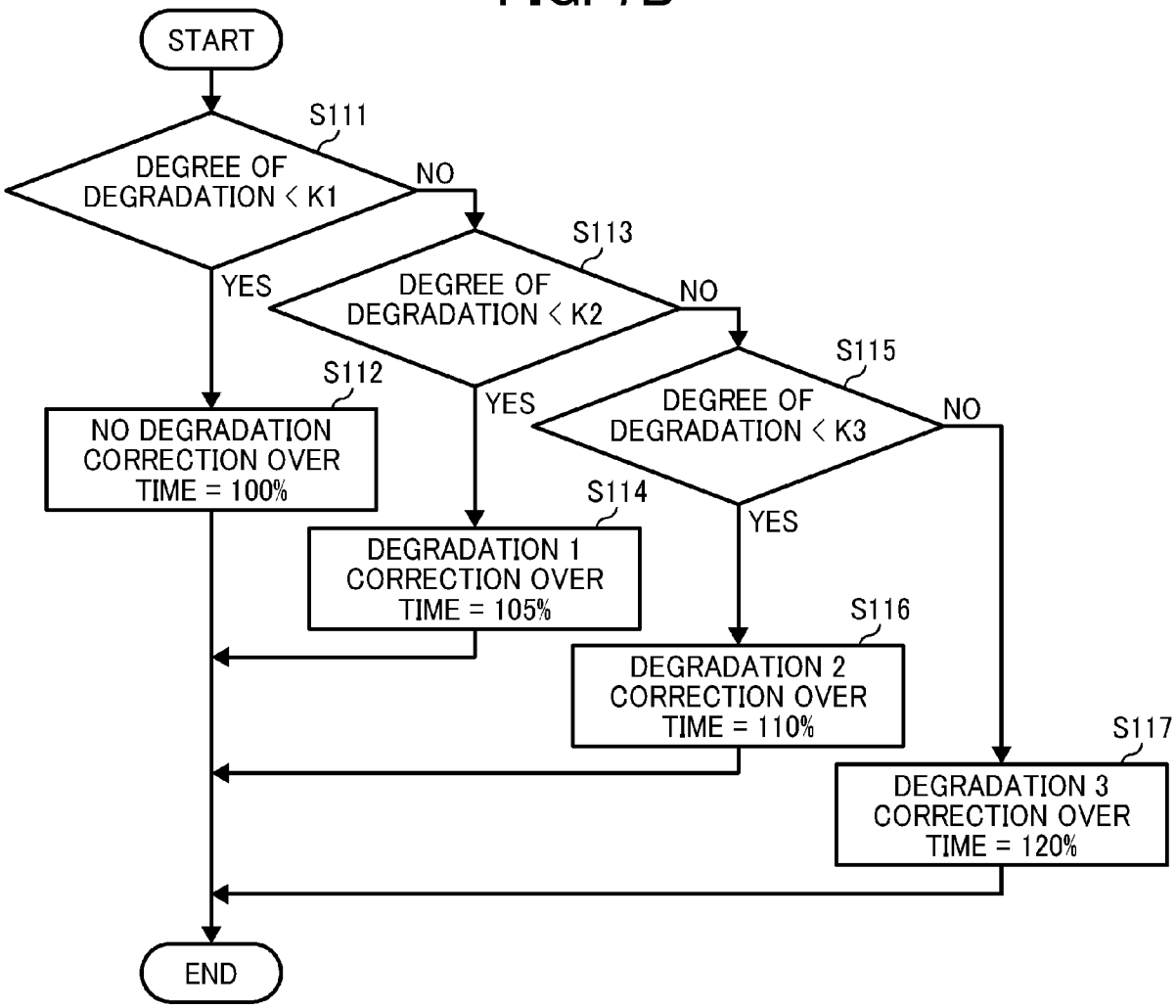
FIG. 7B is a flowchart of another example of a process of determining a time correction amount (time correction coefficient) in Example 1.

For example, in the flowchart illustrated in FIG. 7B, the control unit 16 determines whether the degree of degradation of developer is smaller than the threshold value K1 (S111). When the control unit 16 determines that the degree of degradation of developer is smaller than the threshold value K1 (YES at S111), the control unit 16 sets the time correction coefficient to 100% (S112). When the degree of degradation is not smaller than the threshold value K1 (NO at S111), the control unit 16 determines whether the degree of degradation of developer is smaller than the threshold value K2 (S113). When the control unit 16 determines that the degree of degradation of developer is smaller than the threshold value K2 (YES at S113), the control unit 16 sets the time correction coefficient to 105% (S114). When the degree of degradation is not smaller than the threshold value K2 (NO at S113), the control unit 16 determines whether the degree of degradation of developer is smaller than the threshold value K3 (S115). When the control unit 16 determines that the degree of degradation of developer is smaller than the threshold value K3 (YES at S115), the control unit 16 sets the time correction coefficient to 110% (S116). When the control unit 16 determines that the degree of degradation of developer is not smaller than the threshold value K3 (NO at S115), the control unit 16 sets the time correction coefficient to 120% (S117).

As described above, by increasing the primary transfer current over time in the FCS mode, charge-up (charge injection) in the primary transfer unit is performed to increase the charge amount, thus preventing an insufficient density of the special color toner in the secondary transfer.

The above-described volume resistivity of toner is measured in, for example, the following manner. With an electric press machine, powder of toner particles of 3 g is formed into a pellet of a thickness of approximately 3 mm. The pellet is set in TR-10C, Dielectric Loss Measuring set (Ando Electric Co. Ltd.), and the volume resistively of the toner is obtained from measurement results of the pellet.

Example 2

Next, a second example (Example 2) of time correction of the primary transfer current in the present embodiment is described below. Example 2 differs from the above-described Example 1 in the following point. In Example 1, the degree of degradation of developer calculated from the above-described formula 1 ((conveyance distance of developer)$^2$/consumption of toner) is used as the degree of degradation of developer. By contrast, in Example 2, as the degree of degradation of developer, a detection result of the image density of an image-quality adjustment pattern obtained in the image quality adjustment control (process control), instead of the degree of degradation ((conveyance distance of developer)$^2$/consumption of toner). Therefore, redundant descriptions of the configuration and advantage of Example 2 similar to the configuration and advantage the above-described Example 1 may be omitted below.

First, image-quality adjustment control (process control) is described below. The image-quality adjustment control includes forming a test pattern and performing image density control and positional deviation control, based on results of detection of the test pattern. The image density control includes detecting, for example, the toner adhesion amount (image density) of a density control pattern (image-quality adjustment pattern) obtained by developing a predetermined latent image pattern, and changing, for example, the toner density of developer in the developing device, writing conditions (e.g., exposure power) of the exposure device 113, and the setting values of charging bias and development bias, in accordance with the results of detection of the toner adhesion amount. The positional deviation control includes adjusting the writing timing of latent images for respective color toners in accordance with the detection timing of a positional deviation control pattern (image-quality adjustment pattern).

For the detected position of the image-quality adjustment pattern, for example, the density control pattern is detected on an area of the photoconductor 112 from the development region to the primary transfer unit or on the intermediate transfer belt 131 after the density control pattern is primarily transferred. However, when the diameter of the photoconductor 112 is relatively small, it might be difficult to detect the pattern on the photoconductor 112 due to, e.g., a setting space of detection sensors. Therefore, the density control pattern is preferably detected on the intermediate transfer belt 131. The positional deviation control pattern is detected on the intermediate transfer belt 131 to monitor positional deviations between different color toners due to, for example, variations in distance between the photoconductors 112 and deviations in writing timings of latent images for difference colors. In Example 2, both the density control pattern and the positional deviation control pattern are detected on the intermediate transfer belt 131.

Image-quality adjustment control (process control) is performed, typically, in a non image forming operation period except for an image forming operation period, such as when the power is turned on, before or after a print job (image forming operation) is started, or each time image formation is performed on a predetermined number of sheets. However, to further stabilize the image quality, in the image forming operation period, the image-quality adjustment pattern may be formed in a non image area between an image area (an image portion transferred onto one recording material) and another image area to detect the image-quality adjustment pattern and perform image-quality adjustment control. The image-quality adjustment control performed in the image forming operation period is mainly used to control a toner-density control reference value Vref of the toner density sensor.

The image-quality adjustment pattern includes two types of patterns, that is, a lateral band pattern longer in the main scanning direction and a patched pattern shorter in the main scanning direction for each color. Image densities (toner adhesion amounts) ID of the lateral band pattern and the patched pattern for each color are detected with the detection sensors. The difference ΔID in image density between the lateral band pattern and the patched pattern is calculated and used as the degree of degradation of developer. As described below, the greater the difference ΔID in image density, the greater the degree of decrease in the charge amount of toner.

In other words, as illustrated in FIG. 2, when the primary transfer is performed with an optimal value (initial optimal value) of the primary transfer current at the initial period at which developer is not degraded yet, the primary transfer rates of the patch image and the solid image at the initial period substantially coincide with approximately 97%. By contrast, for the patch image and the solid image after the elapse of time in which developer degrades, the primary transfer rate of the patch image is approximately 94% and the primary transfer rate of the solid image is approximately 84%. There is a large difference in the primary transfer rate between the patch image and the solid image. In other words, as the charge amount of toner decreases with degradation of developer, the difference in the primary transfer rate between the patch image and the solid image increases. From such a correlation, a relationship is obtained that the greater the image density difference ΔID between the lateral band pattern and the patch pattern obtained from results of detection of image density of the lateral band pattern and the patched pattern on the intermediate transfer belt 131, the greater the degree of degradation of developer (the degree of decrease in the charge amount of toner). In other words, as the image density difference ΔID is smaller, the correction amount is set to be smaller. As the image density difference ΔID is greater, the correction amount is set to be greater. Such control can reduce the difference in transfer rate due to the difference in image area ratio.

In Example 2, according to the execution timing of process control, the following image adjustment patterns to correct the transfer current over time are output for each color of special color (S), yellow (Y), magenta (M), cyan (C), and black (K). The patched pattern is a pattern of a single-color, entirely solid image having a maximum density and a size of 20 mm high and 10 mm wide. The lateral band pattern is a single-color, entirely solid image having a maximum density and a size of 20 mm high and 300 mm wide. The image densities (toner adhesion amounts) of the patched pattern and the lateral band pattern are detected on the intermediate transfer belt 131 with the detection sensors (optical sensors). Note that the image-quality adjustment pattern to calculate the degree of degradation of developer is not limited to the above-described examples. Then, the density of toner transferred on the intermediate transfer belt 131 is measured with the detection sensors disposed above the intermediate transfer belt 131.

Figure 8A:
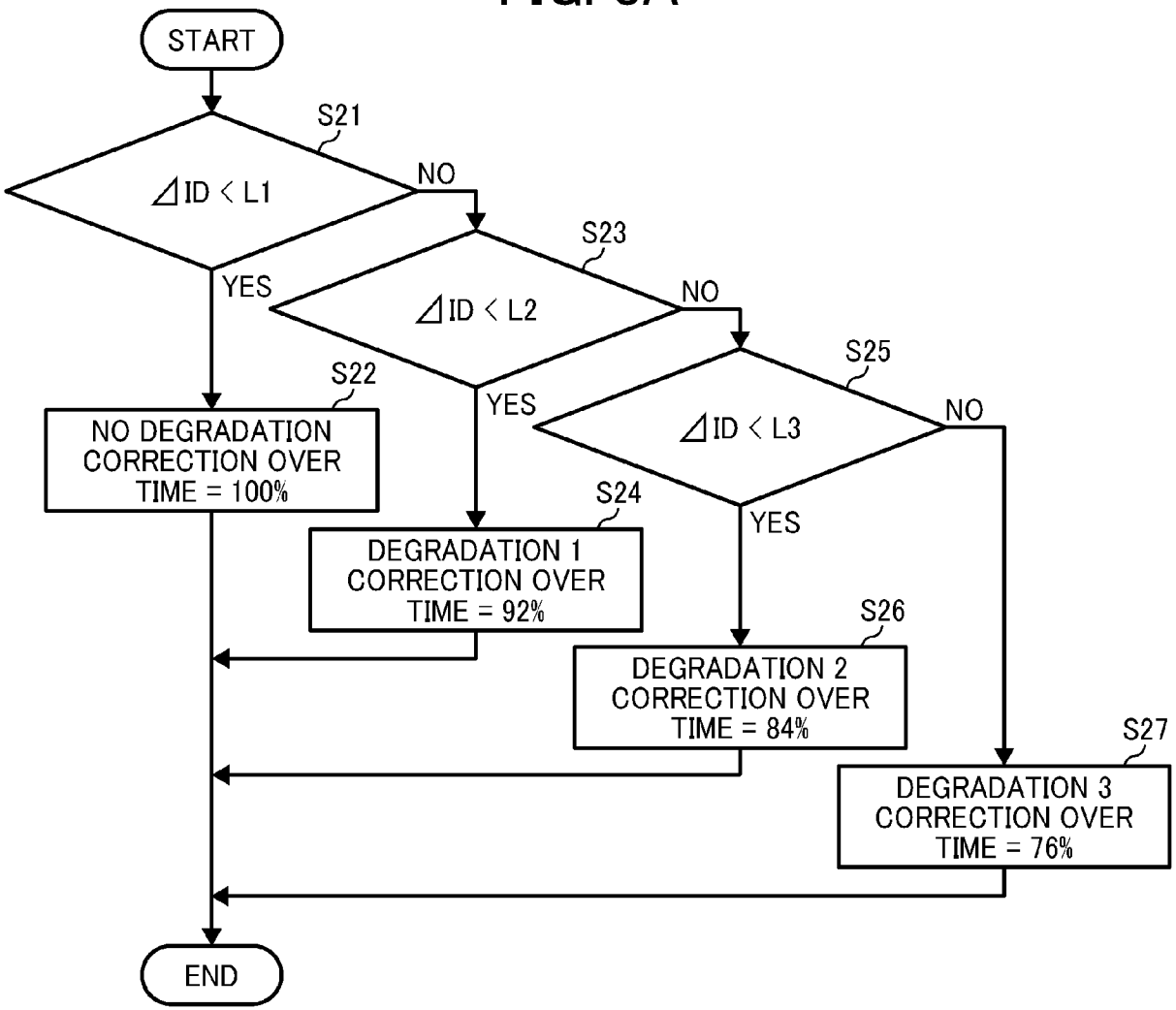
FIG. 8A is a flowchart of an example of a process of determining a time correction amount (time correction coefficient) in Example 2 of the present disclosure.

FIG. 8A is a flowchart of an example of a process of determining the time correction amount (time correction coefficient) in Example 2. As described above, the time correction amount in Example 2 is calculated using image density difference ΔID between the lateral band pattern and the patched pattern as the degree of degradation of developer. For example, as illustrated in FIG. 8A, the control unit 16 determines whether the image density difference ΔID is smaller than a threshold value L1 (S21). When the control unit 16 determines that the image density difference ΔID is smaller than the threshold value L1 (YES at S21), the control unit 16 sets the time correction coefficient to 100% (S22). When the image density difference ΔID is not smaller than the threshold value L1 (NO at S21), the control unit 16 determines whether the image density difference ΔID of the developer is smaller than a threshold value L2 (S23). When the control unit 16 determines that the image density difference ΔID of the developer is smaller than the threshold value L2 (YES at S23), the control unit 16 sets the time correction coefficient to 92% (S24).

When the image density difference ΔID is not smaller than the threshold value L2 (NO at S23), the control unit 16 determines whether the image density difference ΔID of the developer is smaller than a threshold value L3 (S25). When the control unit 16 determines that the image density difference ΔID of the developer is smaller than the threshold value L3 (YES at S25), the control unit 16 sets the time correction coefficient to 84% (S26). When the control unit 16 determines that the degree of degradation of developer is not smaller than the threshold value L3 (NO at S25), the control unit 16 sets the time correction coefficient to 76% (S27). In other words, a large value of the image density difference ΔID between the lateral band pattern and the patched pattern indicates a state in which the value of Q/M is lowered and greatly depends on the image area ratio. A small value of the image density difference ΔID indicates a state in which the value of Q/M is not lowered and less depends on the image area ratio. Accordingly, regardless of image area, an image can be excellently transferred by setting an optimal correction amount according to a change in the degree of dependence of the image area ratio due to a decrease in the image density difference ΔID (=Q/M) between the lateral band pattern and the patched pattern.

In Example 2, as the above-described threshold values, for example, L1=0.08, L2=0.14, and L3=0.20 are used. However, the threshold values are not limited to the above-described values. In Example 2, the image density difference ΔID of developer is categorized into four categories with three threshold values. However, in some embodiments, the image density difference ΔID of developer may be categorized into a larger or smaller number of categories, or the value of the time correction coefficient may be consecutively changed with the value of the image density difference ΔID of developer.

Furthermore, a similar configuration to the transfer configuration of special color toner, such as gold or silver can be used in transfer of process color toner images of yellow, magenta, cyan, and black. Such a configuration allows the process color toner images to be more excellently transferred regardless of the image area ratio, even with toner that has degraded over time and changed in the charge amount of toner (Q/M).

Here, a description is given of an example in which the primary transfer bias is increased over time to prevent an insufficient density of special color toner in the secondary transfer in the FCS mode of Example 2. In the FCS mode of Example 2, timing and a method of increasing the primary transfer current over time are the same as in the S mode of Example 2. The time correction coefficient, which is lowered in the S mode, is stepwisely increased.

Figure 8B:
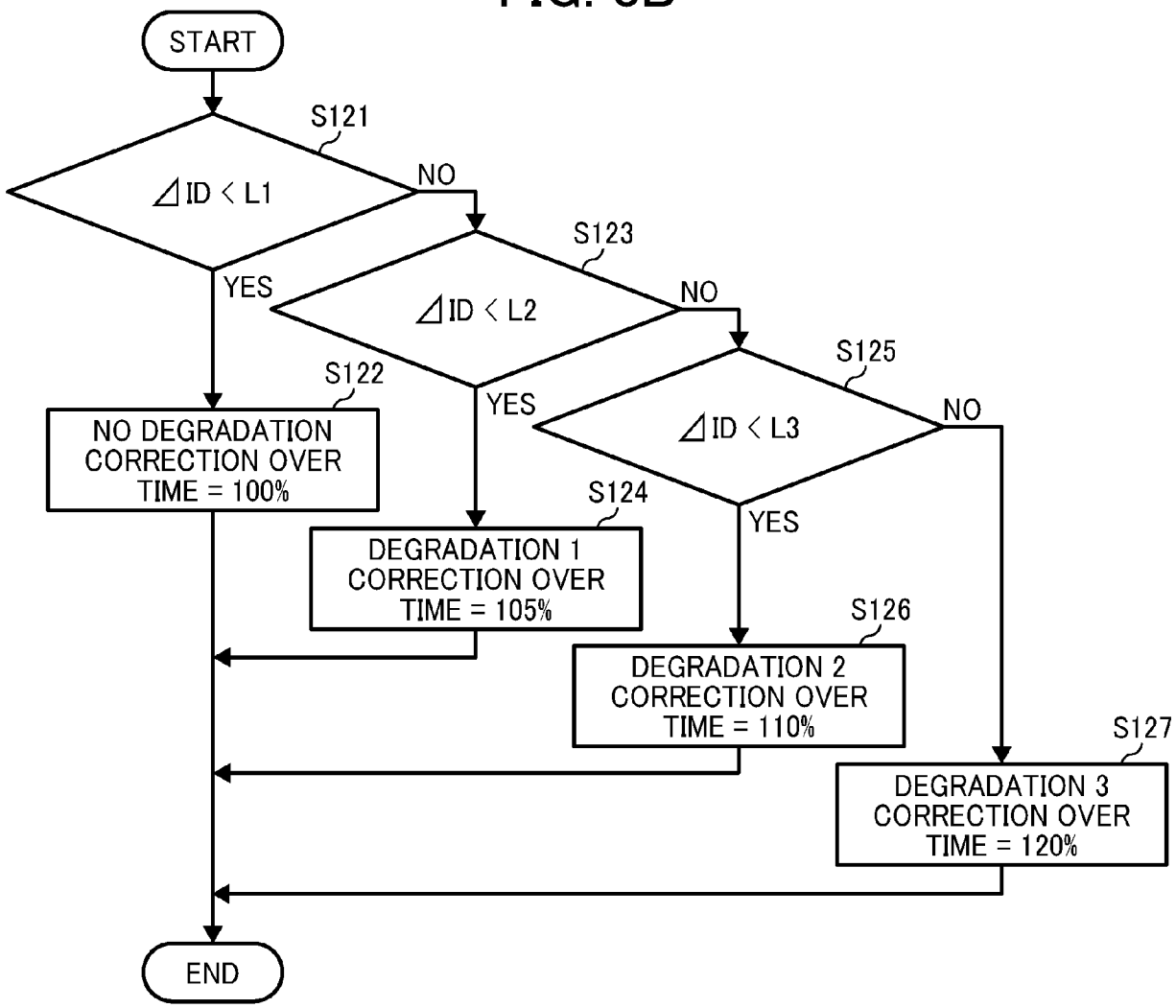
FIG. 8B is a flowchart of another example of a process of determining a time correction amount (time correction coefficient) in Example 2.

For example, as illustrated in FIG. 8B, the control unit 16 determines whether the image density difference ΔID is smaller than the threshold value L1 (S121). When the control unit 16 determines that the image density difference ΔID is smaller than the threshold value L1 (YES at S121), the control unit 16 categorizes the degree of degradation into "no degradation" and sets the time correction coefficient to 100% (S122). When the image density difference ΔID is not smaller than the threshold value L1 (NO at S121), the control unit 16 determines whether the image density difference ΔID of the developer is smaller than a threshold value L2 (S123). When the control unit 16 determines that the image density difference ΔID of the developer is smaller than the threshold value L2 (YES at S123), the control unit 16 categorizes the degree of degradation into "degradation 1" and sets the time correction coefficient to 105% (S124).

When the image density difference ΔID is not smaller than the threshold value L2 (NO at S123), the control unit 16 determines whether the image density difference ΔID of the developer is smaller than a threshold value L3 (S125). When the control unit 16 determines that the image density difference ΔID of the developer is smaller than the threshold value L3 (YES at S125), the control unit 16 categorizes the degree of degradation into "degradation 2" and sets the time correction coefficient to 110% (S126). When the control unit 16 determines that the degree of degradation of developer is not smaller than the threshold value L3 (NO at S125), the control unit 16 categorizes the degree of degradation into "degradation 3" and sets the time correction coefficient to 120% (S127). As described above, in Example 2 as well, by increasing the primary transfer current over time in the FCS mode, charge-up (charge injection) in the primary transfer unit is performed to increase the charge amount, thus preventing an insufficient density of the special color toner in the secondary transfer.

Example 3

Next, a third example (Example 3) of time correction of the transfer current in the present embodiment is described below. Example 3 differs from the above-described Examples 1 and 2 in the following point. In Examples 1 and 2, the time correction of the primary transfer bias is performed according to the degree of degradation of developer. In the present Example 3, according to the degree of degradation of developer, time correction of the secondary transfer bias is performed by time correction of the primary transfer bias. Therefore, redundant descriptions of the configuration and advantage of Examples 1 and 2 similar to the configuration and advantage the above-described Example 1 may be omitted below.

In Example 2, as described above, time correction of the secondary transfer bias is performed by time correction of the primary transfer bias. A reason of the configuration is as follow. When degraded toner is secondarily transferred onto a sheet, a decrease in the value of Q/M of toner affects the secondary transfer and the secondary transfer rate slightly shifts to a lower bias side. Furthermore, when the correction of lowering the primary transfer bias is performed by time correction in primary transfer, the charge amount is less enhanced by charge-up and a decrease in the value of Q/M of toner is more likely to affect the secondary transfer. Therefore, by correcting to decrease the secondary transfer bias by the time correction amount in primary transfer, the secondary transfer bias can be corrected to a more proper value. Even with toner having degraded over time, excellent transfer can be performed regardless of the image area ratio. In addition, decreasing the secondary transfer bias allows a reduction of image degradation due to afterimage or an increase in product life of the transfer member.

Example 4

Next, a fourth example (Example 4) of time correction of the primary transfer current in the present embodiment is described below. The present Example 4 differs from the above-described Examples 1 to 3 in that, in the present Example 4, the time correction amount of the transfer bias is changed according to the use environment as well as the degree of degradation (time degradation) of developer. Therefore, redundant descriptions of the configuration and advantage of Example 4 similar to the configuration and advantage the above-described Examples 1 to 3 may be omitted below.

For example, regarding the reduction in Q/M of toner, as both temperature and humidity are higher or lower, the use environment of developer is more severe and developer is more likely to be degraded. The degree of reduction in the charge amount of toner varies depending on the use environment. Therefore, changing the correction amount according to the use environment allows the transfer bias to be optimally adjusted for the use environment, thus allowing excellent transfer. Here, an example in which the correction amount of the primary transfer bias is changed according to the use environment, in other words, temperature and humidity environment is presented below in Table 2.

TABLE 2

| Categories of | Temperature and Humidity Environment | | | | |
|---|---|---|---|---|---|
| Degradation | L/L | M/L | M/M | M/H | H/H |
| Degradation 1 | 96% | 94% | 92% | 90% | 88% |
| Degradation 2 | 88% | 86% | 84% | 82% | 80% |
| Degradation 3 | 80% | 78% | 76% | 74% | 72% |

The current environment (use environment) is an environment determined according to the flowchart illustrated in FIG. 6. Here, the term "current environment" represents temperature and humidity environments, such as L/L (19° C. and 30%), M/L (23° C. and 30%), M/M (23° C. and 50%), M/H (23° C. and 80%), and H/H (27° C. and 80%). However, the values of temperature and humidity and the combination of temperature and humidity values are not limited to the above-described examples. In the example of Table 2, when the correction of lowering the primary transfer bias according to the degree of degradation of developer is performed, the correction amount of the primary transfer bias is more greatly changed as the temperature and humidity of the use environment are higher. Such a configuration allows the transfer bias to be adjusted to an optimal value according to the use environment in the correction of lowering the primary transfer bias, thus allowing excellent transfer.

When the primary transfer bias is corrected according to the degree of degradation of developer, the primary transfer bias is stepwisely changed. With such a configuration, when the control unit 16 as the correction amount determiner determines the correction amount, the control unit 16 can easily combine the degree of degradation of developer with the use environment to determine the correction amount.

Example 5

Next, a fifth example (Example 5) of time correction of the primary transfer current in the present embodiment is described below.

The present Example 5 differs from the above-described Examples 1 to 4 in that, in the present Example 5, the time correction amount is changed according to change in resistance of the transfer member. Therefore, redundant descriptions of the configuration and advantage of Example 5 similar to the configuration and advantage the above-described Examples 1 to 4 may be omitted below.

For example, the electric resistance of the transfer member is detected, and the time correction amount is determined by combining the detected resistance value and the time correction value. A reason of the configuration is as follow. The electric resistance of the transfer member, such as the primary transfer roller 134 and the intermediate transfer belt 131, greatly affects the transfer performance (transfer rate). In other words, when the resistance of the transfer member is too low, the resistance of a toner layer greatly affects the transfer performance. The voltage applied to, e.g., the primary transfer roller 134 as the transfer member varies with image area, and the transfer efficiency varies between when the image area is small and when the image area is large.

In addition, when the resistance of the transfer member is too high, the application voltage might become excessively high. Consequently, when such an excessively high voltage disturbs an image due to electric-current leakage or the voltage increases up to the upper limit of the capability of the power source, the electric current would not flow. If the current does not flow, the transfer might not be fully performed or the power source might be damaged. Generally, the resistance of components, such as the intermediate transfer belt 131 and the primary transfer roller 134, of the transfer unit may gradually change with application of transfer voltage, such as primary transfer voltage. Accordingly, when the resistance of the transfer member constituting the transfer unit of the transfer device changes, the above-described failure might occur.

Hence, to prevent the occurrence of the above-described failure, in the present Example 5, the electric resistance of the transfer member is detected, and the time correction amount is determined by combining the detected resistance value and the time correction value. The configuration of the present Example 5 is further described below. In the configuration of the present Example 5, an electric characteristic detector is disposed to control the primary transfer bias, which is applied to the primary transfer roller 134, under constant current and detect the applied voltage, to detect a voltage detect the resistance values of the intermediate transfer belt 131 and the primary transfer roller 134 constituting the primary transfer unit. Here, the voltage detection of the primary transfer unit may be performed by any of the voltage detection of only the primary transfer roller 134, the voltage detection of only the intermediate transfer belt 131, and the voltage detection of the primary transfer roller 134 and the intermediate transfer belt 131.

When the electric current used for the detection is, e.g., 25 μA, detected voltages are obtained as presented in Table 3.

TABLE 3

| Resistance of Roller | Detected Voltage |
|---|---|
| $7^{th}$ power | 0.82 kV |
| $7.5^{th}$ power | 1.40 kV |
| $8^{th}$ power | 1.88 kV |
| $8.5^{th}$ power | 2.28 kV |
| $9^{th}$ power | 2.60 kV |

As found in table 3, the transfer voltage varies with the roller resistance of the primary transfer roller 134, and as the roller resistance is higher, the detected voltage is higher. Therefore, the roller resistance, that is, the resistance value of the primary transfer roller 134 as the transfer member is determined from the detected voltage.

The primary transfer rate, which is a rate of the adhesion amount of toner on the photoconductor 112 in the adhesion amount of toner on the intermediate transfer belt 131, varies with change in the roller resistance of the primary transfer roller 134. Hence, table 4 represents the roller resistance of the primary transfer roller 134 and the primary transfer bias at which a maximum primary transfer rate is obtained.

TABLE 4

| Resistance of Roller | Detected Voltage |
|---|---|
| $7^{th}$ power | 29 μA |
| $7.5^{th}$ power | 25 μA |
| $8^{th}$ power | 21 μA |
| $8.5^{th}$ power | 21 μA |
| $9^{th}$ power | 17 μA |

From table 4, when the reference roller resistance is, for example, the $7.5^{th}$ power ($1\times10^{7.5}\Omega$), a proper value of the transfer bias is 25 μA. It is found that, when the roller resistance is the $7^{th}$ power, another proper bias value of 29 μA is obtained by correcting to increase the proper bias value of 25 μA by 4 μA. It is also found that, when the roller resistance is the $8^{th}$ power ($1\times10^{8.0}\Omega$), still another proper bias value of 21 μA is obtained by correcting to decrease the proper bias value of 25 μA by 4 μA. By contrast, when the roller resistance is the $9^{th}$ power ($1\times10^{9.0}\Omega$), image disturbance due to electric discharge occurs at 21 μA and does not occur at 17 μA. The transfer rate is substantially the same between at 21 μA and at 17 μA. From the result, it is found that, when the roller resistance is the $9^{th}$ power ($1\times10^{9.0}\Omega$), still yet another proper bias value of 17 μA is obtained by correcting to decrease the proper bias value of 25 μA by 8 μA.

The time correction of the primary transfer bias according to the roller resistance of the primary transfer roller 134 can be determined based on whether the detected voltage is lower or higher than a threshold voltage. By combining the above-described time correction according to toner degradation with the time correction according to the roller resistance, the primary transfer current can be more reliably set to an optimal value. Here, an example is presented below in table 5.

TABLE 5

| Detected Voltage | Resistance of Roller | Categories of Degradation | | | |
|---|---|---|---|---|---|
| | | No Degradation | Degradation 1 | Degradation 2 | Degradation 3 |
| 1.0 kV or lower | $7^{th}$ power | 117% | 108% | 98% | 89% |
| Greater than 1.0 kV and 1.6 kV or lower | $7.5^{th}$ power | 100% | 92% | 84% | 76% |
| Greater than 1.6 kV and 2.4 kV or lower | $8^{th}$ to $8.5^{th}$ power | 83% | 76% | 70% | 63% |
| 2.4 kV or greater | $9^{th}$ power | 67% | 62% | 56% | 51% |

Even when the roller resistance of the primary transfer roller or the Q/M of toner changes, changing the correction amount as presented in table 5 allows setting (selecting) of the primary transfer bias at which a maximum primary transfer rate is obtained, thus reducing (preventing) occurrence of image failure.

In the above-described description, the example is described in which the resistance (roller resistance) of the primary transfer roller 134 changes. When the resistance of the intermediate transfer belt 131 changes, a similar change occurs. Therefore, advantages equivalent to the case of the primary transfer roller 134 can be obtained by similarly correcting the primary transfer bias according to the resistance of the intermediate transfer belt 131. In the present Example 5, the control unit 16 controls the correction of the primary transfer bias based on the above-described electric characteristic detector (detection method) and a predetermined threshold, and acts as the correction-amount determiner. In the present Example 5, the correction is performed by the voltage detection under constant current control. Note that, the correction can also be performed similarly by the electric-current detection under constant voltage control.

In other words, the following advantages can be obtained by changing the time correction amount of the transfer bias according to change in the resistance of the transfer member constituting the transfer unit. The electric resistance of the transfer member greatly affects the transfer performance. Therefore, detecting the electric resistance of the transfer member and combining the detected resistance value and the time correction value allows the transfer bias to be adjusted to a more proper value, thus allowing more excellent transfer.

In the example of Table 5, when the correction of lowering the primary transfer bias according to the degree of degradation of developer is performed, the correction amount of the primary transfer bias is more greatly changed as the change amount of the resistance of the transfer member constituting the transfer unit from the reference resistance value. Such a configuration allows a more proper primary transfer bias to be set according to the degree of degradation of developer and the resistance of the primary transfer roller 134 when the correction of lowering the primary transfer bias is performed.

Here, since the above-described voltage detection generally accompanies with a mechanical operation of reading the voltage with the transfer current flowing for a period of time, the productivity may be reduced by the voltage detecting operation. By contrast, the image forming apparatus 1 according to the present embodiment generally performs the process control for image-quality adjustment in a dedicated time other than during image formation. Therefore, the above-described reduction in productivity due to separate execution of the voltage detection can be prevented by performing the above-described voltage detection together during the process control for image-quality adjustment. Hence, in the present Example 5, the above-described voltage detecting operation is performed when the process control for image-quality adjustment is performed.

When the primary transfer bias is corrected according to the degree of degradation of developer, the primary transfer bias is stepwisely changed. With such a configuration, when the control unit 16 as the correction amount determiner determines the correction amount, the control unit 16 can easily combine the degree of degradation of developer with the roller resistance of the primary transfer roller 134 to determine the correction amount.

In the above description, embodiments of the present disclosure are described with the plurality of examples. However, embodiments of the present disclosure are not limited to the above-described embodiment. Modifications and alterations of the embodiments can be made without departing from the spirit and scope of the invention described in the claims unless limited in the above description. For example, the detection of the degree of degradation and the determination of whether the degree of degradation of developer has reached a level of executing the time correction of the primary transfer current may be performed only for an image forming unit(s) used in instant image formation, instead of being performed invariably for all of the image forming units of the image forming apparatus. The control of the primary transfer current may be performed by the control of the voltage value, instead of the control of the electric-current value. Developer may be a two-component developing agent containing toner and carrier as described above or a one-component developing agent containing toner. The detection sensor to detect the lateral band pattern and the patched pattern may be disposed at each of the image forming units.

The image forming apparatus according to an embodiment of the present disclosure is not limited to the above-described image forming apparatus of the tandem system and may be, for example, an image forming apparatus of a single drum system in which toner images of different colors are sequentially formed on a single photoconductor drum so that the toner images of different colors are superimposed one on another. The image forming apparatus is not limited to the above-described multifunction peripheral and may be, for example, a single-function machine, such as a printer or facsimile machine, or a multifunction peripheral having at least two functions of such single-function machines. The advantages and effects described in the above-described embodiments are examples of the advantages and effects obtained from the above-described embodiments. The advantages and effects obtained by other embodiments are not limited to the above-described examples.

The above-described embodiments and examples are limited examples, and the present disclosure includes, for example, the following aspects having advantages.

Aspect A

According to Aspect 1, there is provided a transfer device, such as the transfer unit 13, used in an image forming apparatus, such as the image forming apparatus 1, which transfers toner images, such as S, Y, M, C, and K toner images, from a plurality of image bearers, such as the photoconductors 112S, 112Y, 112M, 112C, and 112K, onto an intermediate transfer member, such as the intermediate transfer belt 131, to form an image, such as a multicolor image. The image forming apparatus includes a plurality of image forming units, such as the image forming units 110Y, 110M, 110C, and 110K, to form process color toners, such as cyan (C), magenta (M), yellow (Y), and black (K), and at least another image forming unit, such as the image forming unit 110S, to form at least one type of special color or colorless toner image, such as a special color (S) toner image of gold or silver. The transfer device corrects a transfer bias, such as the primary transfer bias for the special color to transfer the special color toner onto the intermediate transfer member by stepwisely decreasing the transfer bias in a special color mode, such as the S mode, to form an image with only the special color toner and stepwisely increasing the transfer bias in a full color mode, such as the FCS mode, to form an image with all colors, according to the degree of degradation of developer used to form the special color toner.

According to Aspect A, as described in the above-described embodiment, for example, the following advantage can be obtained. Generally, special color toners have different electric characteristics depending on pigments used in the special color toners. For example, pigments of, e.g., gold or silver toner, are electrically conductive and have a low volume resistivity. Generally, toner of a low volume resistivity is less likely to retain charge than toner of a high volume resistivity. Such phenomenon is supposed to occur because a reduction in resistance causes a reduction in apparent electrostatic capacity. Accordingly, as the charge performance of carriers decreases over time, the charge amount of toner is more likely to decrease than process color toner of a relatively high volume resistivity. As the charge amount of toner decreases over time, the optimal value of the transfer current in, particularly, an image of a high image area ratio (e.g., an entirely solid image) shifts between at the initial period of use and after the elapse of time. Under a constant transfer current, an excess transfer may occur over time and the transfer rate may decrease, causing a thin-color image. In such a case, it is particularly effective to reduce the transfer bias so as to lower the transfer current over time.

However, when a special color toner is transferred, the secondary transfer bias in the full color mode is set higher than in the special color mode. Accordingly, the special color toner having turned into a lower charged state over time may be excessively transferred in secondary transfer and be thin in an image. By contrast, for the special color mode, since the secondary transfer bias is not set to be so higher than in the full color mode, such a phenomenon does not occur in which the special color toner is excessively transferred in the secondary transfer and thin in the image. Hence, in the special color mode, the primary transfer bias is controlled to decrease over time, thus allowing excellent transfer to be performed regardless of the image area ratio. In the full color mode, to prevent an insufficient density of special color toner in the secondary transfer, the primary transfer bias is controlled to increase over time. Thus, the charge amount is increased by charge-up (charge injection) in the primary transfer unit, preventing an insufficient density of the special color toner in the secondary transfer. Such a configuration can provide a transfer device capable of excellently transferring a special color toner image even using developer having degraded over time.

Aspect B

In Aspect A, the special color toner forming the special color toner image is metallic luster toner of a special color (S), such as gold or silver. According to Aspect B, as described in the above-described embodiment, for example, the following advantage can be obtained. According to Aspect B, a transfer device can be provided that can transfer a brilliant, metallic luster image, which is not obtained by metallic luster produced by superimposing process color toners of, e.g., yellow, magenta, cyan, and black to meet customers' demand.

Aspect C

In Aspect A or B, the transfer bias to transfer the special color toner image onto the intermediate transfer member is corrected to decrease according to a calculated value, such as a value calculated by the above-described formula 1 using the conveyance distance of developer used to form the special color toner image and the consumption of toner.

According to Aspect C, as described in the above-described embodiment, for example, the following advantage can be obtained. Toner having degraded over time decreases in the value of Q/M. As the value of Q/M is lower, the dependency of the primary transfer rate on the image area ratio in the main scanning direction (image ratio in the main scanning direction) is greater. The transfer rate shifts with the image area in main scanning direction. For example, when toner has degraded over time, an image of a lower image area ratio (e.g., a patch image) is less affected by the degree of degradation. However, an image of a higher image area ratio (e.g., an entirely-solid image) is more likely to be excessively transferred and result in a thin image (in other words, the transfer rate is more likely to shift to a lower electric-current side and be excessively transferred, thus reducing the transfer rate. The value of Q/M is likely to decrease under conditions, such as low duty and low coverage. Hence, the correction of lowering the transfer current is performed based on a value calculated from the travel distance (duty) of developer and the consumption (coverage) of toner, which is obtained by formula 1. Even when toner having degraded over time is used, such a configuration can prevent an image of a higher image area ratio from being formed thin. For the correction amount, the correction is performed to an extent not to affect the patch density and an optimal correction amount is set to balance the patch image and the entirely-solid image, thus allowing excellent transfer to be performed regardless of image area. Accordingly, even using developer having degraded over time, a special color toner image can be excellently transferred regardless of the image area ratio.

Aspect D

In Aspect C, the transfer bias to transfer a toner image of each process color onto the transfer target is corrected to decrease according to a calculated value, such as a value calculated using the conveyance distance of developer used to form the toner image of each process color and the consumption of toner. According to Aspect D, as described in the above-described embodiment, the transfer device can perform excellent transfer regardless of the image area ratio, even with developer having degraded over time.

Aspect E

In Aspect A or B, the image forming apparatus includes a controller to perform process control to detect, on the intermediate transfer member, the density of a toner adhesion pattern for image-quality adjustment, such as an image-quality adjustment pattern, formed on a non image area of the image bearer. The toner adhesion pattern for image-quality adjustment includes at least a patched pattern and a lateral band pattern extending in a main scanning direction. The controller calculates a difference in image density, such as the image density difference ΔID, between a toner image of the patched pattern and a toner image of the lateral band pattern for each of process colors and a special color to be transferred. The controller performs correction to decrease the transfer bias to transfer the special color toner image onto the intermediate transfer member, according to a value of the calculated difference of the special color.

According to Aspect E, as described in the above-described embodiment, for example, the following advantage can be obtained. By adding the lateral band pattern extending in the main scanning direction to an image adjustment pattern of a patched shape, the toner density can be measured both when the image area is small (patched pattern) and when the image area is large (lateral band pattern). As the image density difference ΔID between when the image area is small (patched pattern) and when the image area is large (lateral band pattern) is smaller, the correction amount is set to be smaller. As the image density difference ΔID is greater, the correction amount is set to be greater. Such control can reduce the difference in transfer rate due to the difference in image area ratio. In other words, a large value of the image density difference ΔID between the lateral band pattern and the patched pattern indicates a state in which the value of Q/M is lowered and greatly depends on the. A small value of the image density difference ΔID indicates a state in which the value of Q/M is not lowered and less depends on the image area ratio. Accordingly, by setting an optimal correction amount is set according to the difference in toner adhesion amount between the patch pattern and the lateral band pattern, in other words, the dependency of the image area ratio due to a reduction of Q/M, excellent transfer can be performed regardless of image area. Thus, even using developer having degraded over time, a special color toner image can be excellently transferred regardless of the image area ratio.

Aspect F

In Aspect E, the transfer bias to transfer a toner image of each process color onto the transfer target is corrected to decrease according to a calculated value of the difference of each process color. According to Aspect F, as described in the above-described embodiment, the transfer device can perform excellent transfer regardless of the image area ratio, even with developer having degraded over time.

Aspect G

In any of Aspects A to F, the transfer device includes a primary transfer unit including, for example, the primary transfer roller 134 and the intermediate transfer belt 131, to primarily transfer a toner image from the image bearer onto the intermediate transfer member and a secondary transfer unit to secondarily transfer the toner image from the intermediate transfer member onto a transfer target, such as a sheet material. A secondary transfer bias applied to the secondary transfer unit including, for example, the secondary-transfer opposed roller 136 and the intermediate transfer belt 131 is also corrected according to the correction amount used to correct the primary transfer bias.

According to Aspect G, as described in the above-described embodiment, for example, the following advantage can be obtained. When toner having degraded over time is secondarily transferred onto a transfer target medium, such as a sheet, a decrease in the value of Q/M of toner also affects the secondary transfer and the secondary transfer rate slightly shifts to a lower bias side. Furthermore, for example, when the time correction of lowering the primary transfer bias is performed in primary transfer, the charge amount is less enhanced by charge-up and a decrease in the value of Q/M of toner is more likely to affect the secondary transfer. Accordingly, by correcting the secondary transfer bias with the time correction amount in primary transfer to decrease the secondary transfer bias, the secondary transfer bias can be set to a proper value, thus allowing excellent transfer. In addition, decreasing the secondary transfer bias can reduce image degradation due to afterimage or increase the product life of the transfer member, such as the primary transfer roller 134 or the intermediate transfer belt 131.

Aspect H

In Aspect G, when the correction of lowering the primary transfer bias is performed, the correction of lowering the secondary transfer bias is also performed according to the correction amount.

According to Aspect G, as described in the above-described embodiment, for example, the following advantage can be obtained. When toner having degraded over time is secondarily transferred onto a transfer target medium, such as a sheet, a decrease in the value of Q/M of toner also affects the secondary transfer and the secondary transfer rate slightly shifts to a lower bias side. Furthermore, when the time correction of lowering the primary transfer bias is performed in primary transfer, the charge amount is less enhanced by charge-up and a decrease in the value of Q/M of toner is more likely to affect the secondary transfer. Accordingly, by correcting the secondary transfer bias with the time correction amount of lowering the primary transfer bias in primary transfer to decrease the secondary transfer bias, the secondary transfer bias can be set to an optimal value, thus allowing excellent transfer. In addition, decreasing the secondary transfer bias can reduce image degradation due to afterimage or increase the product life of the transfer member, such as the primary transfer roller 134 or the intermediate transfer belt 131.

Aspect I

In any of Aspects A to H, the correction amount used to correct the transfer bias, such as the primary transfer bias or the secondary transfer bias, is changed according to change in use environment, such as temperature, humidity, and ambient environment. According to Aspect I, as described in the above-described embodiment, for example, the following advantage can be obtained. Regarding the reduction in Q/M of toner, as both temperature and humidity are higher or lower, the use environment of developer is more severe and developer is more likely to be degraded. The degree of reduction in the charge amount of toner varies depending on the use environment. Therefore, changing the correction amount according to the use environment allows the transfer bias to be optimally adjusted for the use environment, thus allowing excellent transfer.

Aspect J

In Aspect I, when the correction of lowering the primary transfer bias according to the degree of degradation of developer is performed, the correction amount of the primary transfer bias is more greatly changed as the temperature and humidity of the use environment are higher. As described in the above-described embodiment, such a configuration allows the transfer bias to be adjusted to an optimal value according to the use environment in the correction of lowering the primary transfer bias, thus allowing excellent transfer.

Aspect K

In any of Aspects A to J, the correction amount used to correct the transfer bias is changed according to change in the resistance of the transfer member, such as the primary transfer roller 134, the secondary transfer roller 135, or the intermediate transfer belt 131 constituting the transfer unit, such as the primary transfer unit or the secondary transfer unit. According to Aspect K, as described in the above-described embodiment, for example, the following advantage can be obtained. The electric resistance of the transfer member greatly affects the transfer performance. Accordingly, by detecting the electric resistance of the transfer member and combining the detected resistance value and the time correction value, a more proper transfer bias can be set, thus allowing excellent transfer.

Aspect L

In Aspect K, when the correction of lowering the primary transfer bias according to the degree of degradation of developer is performed, the correction amount of the primary transfer bias is more greatly changed as the change amount of the resistance of the transfer member constituting the transfer unit from the reference resistance value, such as the $7.5^{th}$ power ($1\times10^{7.5}\Omega$). According to Aspect L, as described in the above-described embodiment, when the correction of lowering the primary transfer bias is performed, the primary transfer bias can be set to a proper bias according to the degree of degradation of developer and the resistance of the transfer member, thus allowing excellent transfer.

Aspect M

In any of Aspects A to L, when the primary transfer bias is corrected according to the degree of degradation of developer, the transfer bias is stepwisely changed. According to Aspect M, when a correction amount determiner, such as the control unit 16, determines the correction amount, the correction amount determiner can easily combine the degree of degradation of developer with the use environment to determine the correction amount.

Aspect N

An image forming apparatus, such as the image forming apparatus 1, includes a transfer device to transfer toner images, such as the S, Y, M, C, and K toner images, formed on a plurality of image bearers, such as the photoconductors 112S, 112Y, 112M, 112C, and 112K, onto an intermediate transfer member, such as the intermediate transfer belt 131. The transfer device is the transfer device, such as the transfer unit 13, according to any of Aspects A to M. According to Aspect N, as described in the above-described embodiment, there is provided an image forming apparatus having advantages equivalent to the advantages of the transfer device according to any of Aspects A to M. In other words, an image forming apparatus is provided that can perform excellent transfer regardless of the image area ratio, even with toner having degraded over time.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a plurality of image forming units to form a process color toner image and a special color toner image;

a plurality of image bearers to bear the process color toner image and the special color toner image; and a transfer device including an intermediate transfer member, to transfer the process color toner image and the special color toner image from the plurality of image bearers onto the intermediate transfer member; and a controller configured to correct a transfer bias applied to transfer the special color toner image onto the intermediate transfer member, the controller being further configured to decrease the transfer bias in a special color mode, in which image formation is performed with only a special color, and increase the transfer bias in a full color mode, in which image formation is performed with the special color and a process color, according to a degree of degradation of a developer used to form the special color toner image.

2. The image forming apparatus according to claim 1, wherein the special color toner image includes metallic luster toner.

3. The image forming apparatus according to claim 1, wherein the special color toner image includes colorless toner.

4. The image forming apparatus according to claim 1, wherein the controller is configured to decrease the transfer bias according to a calculation value calculated with a conveyance distance of the developer used to form the special color toner image and a consumption of toner.

5. The image forming apparatus according to claim 1, wherein the controller is configured to decrease a transfer bias applied to transfer the process color toner image, according to a calculation value calculated with a conveyance distance of a developer used to form the process color toner image and a consumption of toner.

6. The image forming apparatus according to claim 1, wherein the controller is configured to perform process control to change an image forming condition according to a detection value of a sensor to detect, on the intermediate transfer member, a density of a toner adhesion pattern for image adjustment formed on a non-image formation area of the plurality of image bearers, wherein the toner adhesion pattern includes at least a patched pattern and a lateral band pattern extending in a main scanning direction, and wherein the controller is configured to calculate a difference in density between a toner image of the patched pattern and a toner image of the lateral band pattern for each of the process color and the special color and decrease the transfer bias according to a calculated value of the difference of the special color.

7. The image forming apparatus according to claim 6, wherein the controller is configured to decrease a transfer bias applied to transfer the process color toner image, according to a calculated value of the difference of the process color.

8. The image forming apparatus according to claim 1, further comprising:

a primary transfer unit to transfer the process color toner image and the special color toner image from the plurality of image bearers onto the intermediate transfer member by a primary transfer bias; and a secondary transfer unit to transfer the process color toner image and the special color toner image from the intermediate transfer member onto a transfer target by a secondary transfer bias, wherein the controller is configured to correct the primary transfer bias with a correction amount and also correct the secondary transfer bias with the correction amount with which the controller corrects the primary transfer bias.

9. The image forming apparatus according to claim 8, wherein the controller is configured to decrease the secondary transfer bias according to the correction amount when the controller corrects the primary transfer bias to decrease the primary transfer bias.

10. The image forming apparatus according to claim 8, wherein the controller is configured to more greatly change the correction amount according to the degree of degradation of the developer as temperature and humidity of use environment are higher, when the controller corrects the primary transfer bias to decrease the primary transfer bias.

11. The image forming apparatus according to claim 8, wherein the controller is configured to more greatly change the correction amount of the primary transfer bias according to the degree of degradation of the developer as an amount of change in resistance of a transfer member of the transfer device from a reference resistance value is greater, when the controller corrects the primary transfer bias to decrease the primary transfer bias.

12. The image forming apparatus according to claim 1, wherein the controller is configured to change the transfer bias according to a change in use environment.

13. The image forming apparatus according to claim 1, wherein the controller is configured to change a correction amount of the transfer bias according to a change in resistance of a transfer member of the transfer device.

14. The image forming apparatus according to claim 1, wherein the controller is configured to change the transfer bias in a stepwise manner according to the degree of degradation of the developer.

* * * * *